US008201355B2

(12) United States Patent
Couture et al.

(10) Patent No.: US 8,201,355 B2
(45) Date of Patent: Jun. 19, 2012

(54) RAIL ATTACHMENT MECHANISM

(75) Inventors: Eric D. Couture, Manchester, NH (US); Andrew D. Russell, Amherst, NH (US); Kenneth S. Solinsky, Bedford, NH (US)

(73) Assignee: L-3 Insight Technology Incorporated, Londonderry, NH (US)

( * ) Notice: Subject to any disclaimer, the term of this patent is extended or adjusted under 35 U.S.C. 154(b) by 254 days.

(21) Appl. No.: 12/536,257

(22) Filed: Aug. 5, 2009

(65) Prior Publication Data

US 2010/0031553 A1 Feb. 11, 2010

Related U.S. Application Data

(60) Provisional application No. 61/086,304, filed on Aug. 5, 2008, provisional application No. 61/105,544, filed on Oct. 15, 2008.

(51) Int. Cl.
*F41G 1/387* (2006.01)

(52) U.S. Cl. ..... 42/127; 42/124

(58) Field of Classification Search ..... 42/124, 42/125, 126, 127

See application file for complete search history.

(56) References Cited

U.S. PATENT DOCUMENTS

| | | | | |
|---|---|---|---|---|
| 7,614,175 | B2 * | 11/2009 | Davis et al. | 42/127 |
| 7,712,242 | B2 * | 5/2010 | Matthews et al. | 42/90 |
| 2008/0216380 | A1 * | 9/2008 | Teetzel | 42/127 |

* cited by examiner

*Primary Examiner* — Stephen M Johnson
(74) *Attorney, Agent, or Firm* — L-3 Communications

(57) ABSTRACT

A rail mounting mechanism for coupling an auxiliary device to a weapon has an eccentric hub and a blade with a lever arm that can be used to overcome tolerances in mounting rails to provide a consistent grasp of the rail.

11 Claims, 22 Drawing Sheets

RAIL ATTACHMENT MECHANISM

CROSS REFERENCE TO RELATED APPLICATIONS

The present application claims the benefit of U.S. provisional patent application Ser. No. 61/086,304, filed Aug. 5, 2008 and Ser. No. 61/105,544, filed Oct. 15, 2008, the entire disclosures of which are incorporated herein by reference.

BACKGROUND

The need to effectively see a target and aim a weapon in the direction of the target is well recognized. Auxiliary devices to facilitate illuminating a target or aiming a weapon are known. Examples of known auxiliary devices include scopes, visible and infrared illuminators, laser pointers, combined illuminator/laser pointer devices, night vision devices and infrared imagers. For convenience, these (and other) devices are generally referred to herein as auxiliary devices. These auxiliary devices are often mounted to weapons having rail mounting systems with a certain profile, for example a rail profile consistent with MIL-STD-1913. Although these rail profiles have tolerances, these tolerances can vary enough to cause auxiliary devices to not fit properly and therefore not maintain boresight after continued use.

BRIEF DESCRIPTION OF THE DRAWINGS

For a better understanding of the present disclosure, together with other objects, features and advantages, reference should be made to the following detailed description, which should be read in conjunction with the following figures wherein.

DETAILED DESCRIPTION OF THE EMBODIMENTS

Figure 1:
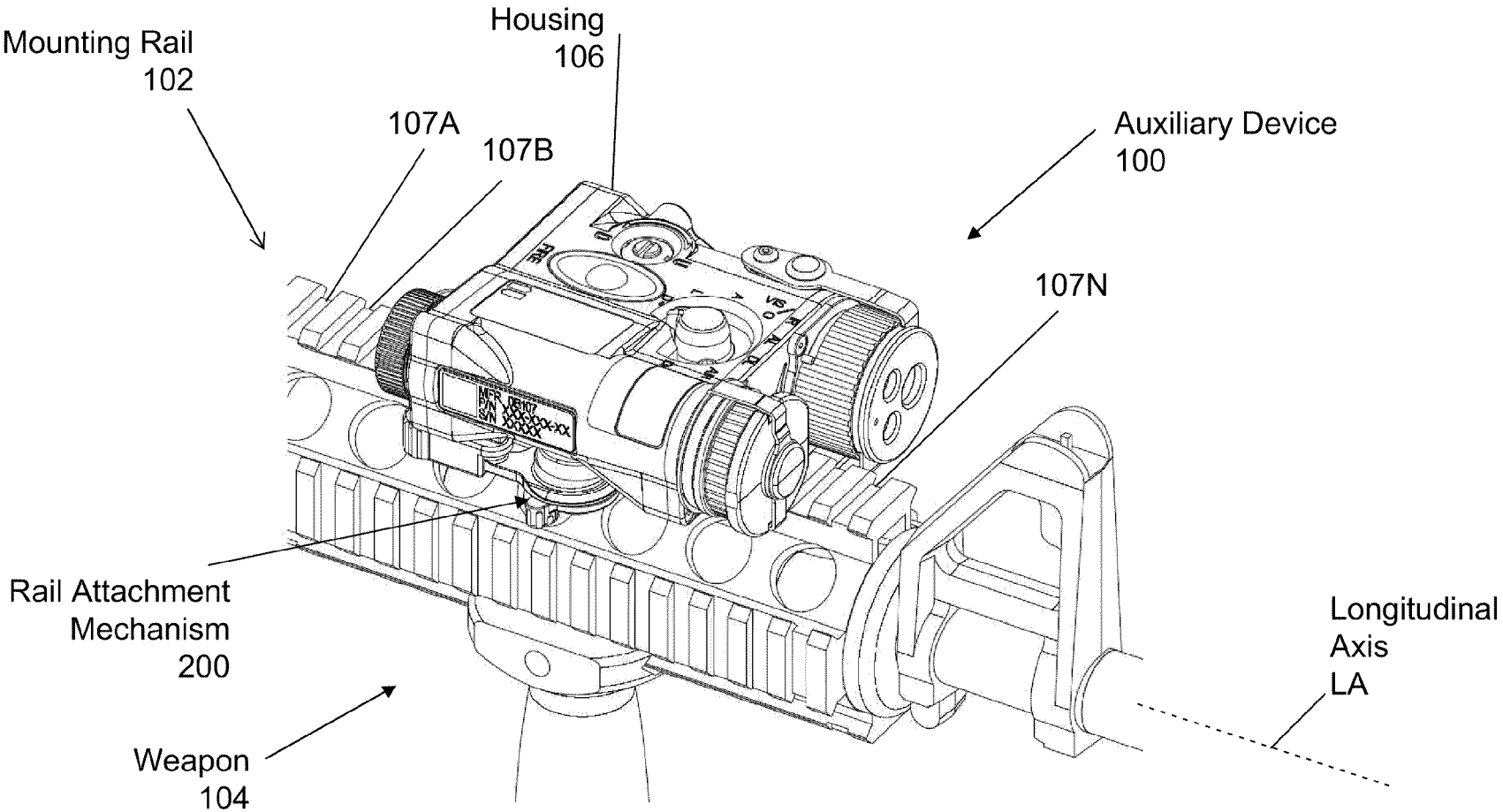
FIG. 1 is a first isometric view of an auxiliary device coupled to a mounting rail of a weapon with a rail attachment mechanism consistent with a first embodiment of the present disclosure.
Figure 2:
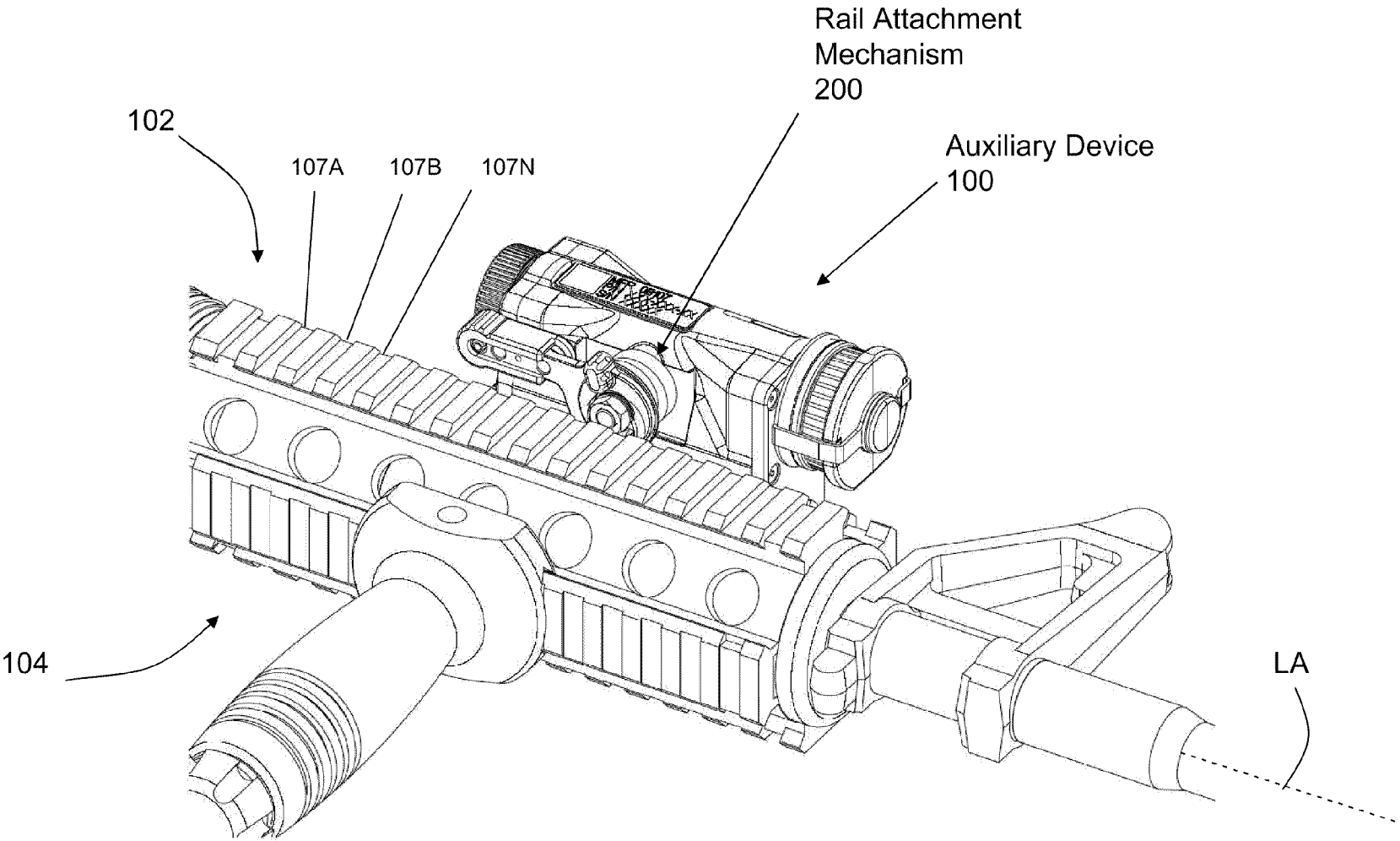
FIG. 2 is a second isometric view of the auxiliary device of FIG. 1.

FIG. 1 is a first isometric view and FIG. 2 is a second isometric view of an auxiliary device 100 coupled to a mounting rail 102 of a weapon 104 with a rail attachment mechanism 200 consistent with at least one embodiment of the present disclosure. The auxiliary device 100 may have a housing 106 for enclosing internal components, for example optics and electronics. The housing 106 may have an integral clamp member 108 (see, for example, FIG. 6A) configured to selectively engage an edge(s) of the mounting rail 102. The rail attachment mechanism 200, along with the integral clamp member 108, may be configured to selectively couple, secure and/or fix the position of the auxiliary device 100 relative to the mounting rail 102.

Auxiliary devices 100 include, but are not limited to sights, scopes, laser illuminators, laser pointers, flashlights, and combined laser illuminator/pointer devices, night vision devices and infrared imagers. These auxiliary devices 100 may be secured to one of the rails 102 on a weapon 104 and may be aligned parallel with a longitudinal axis LA of the weapon 104. The auxiliary device 100 may be secured to a rail 102 disposed above, below, or on the side of the weapon 104, depending on its intended purpose. The rail 102 may have a MIL-STD-1913, Weaver, or other profile and may include one or more cross slots 107A-N. The cross slot 107A-N may be used to assist in resisting movement of the auxiliary device 100 along the longitudinal axis LA of the weapon 104 during recoil.

Figure 3A:
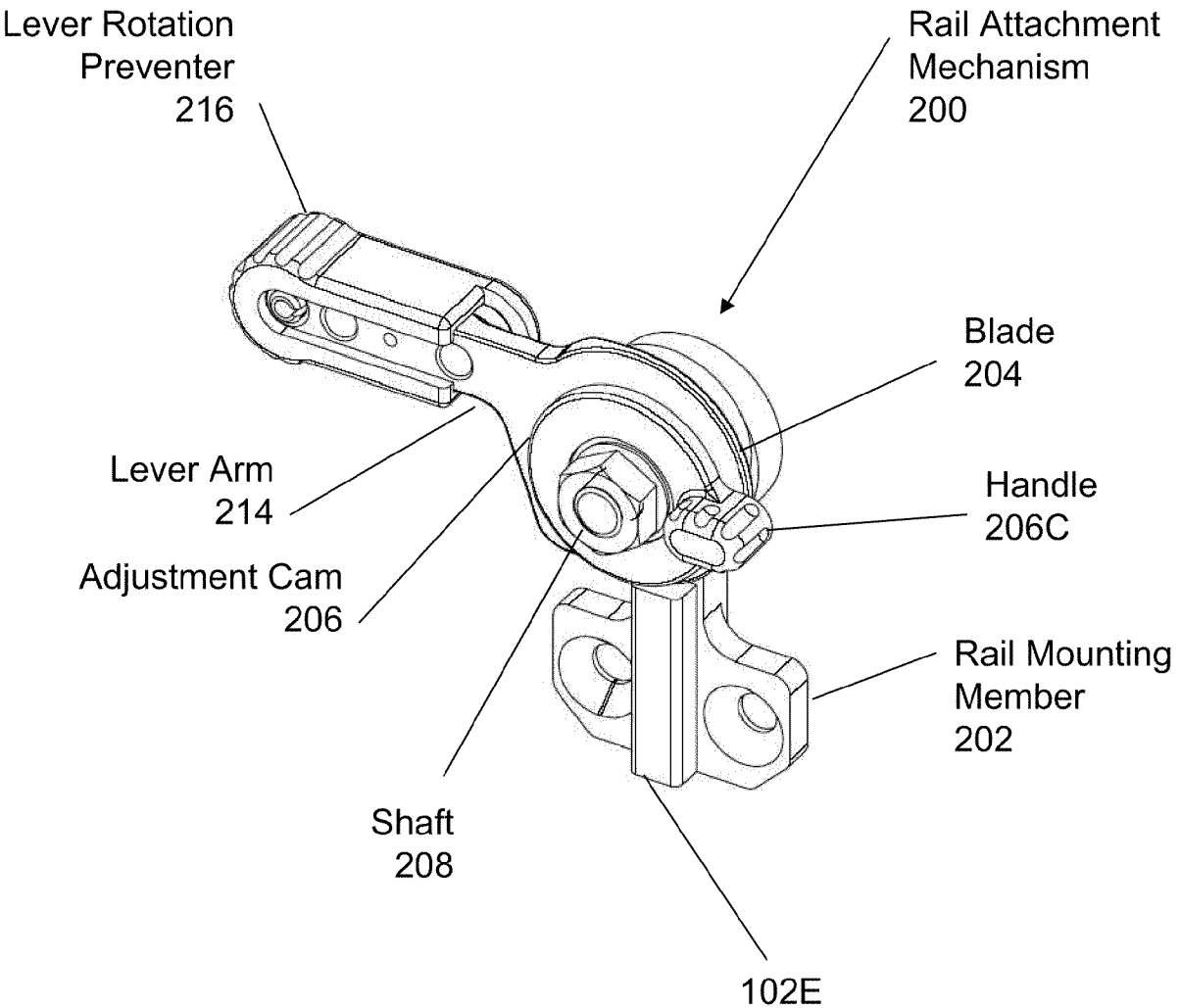
FIG. 3A is an isometric view of the rail attachment mechanism of FIG. 1.
Figure 3B:
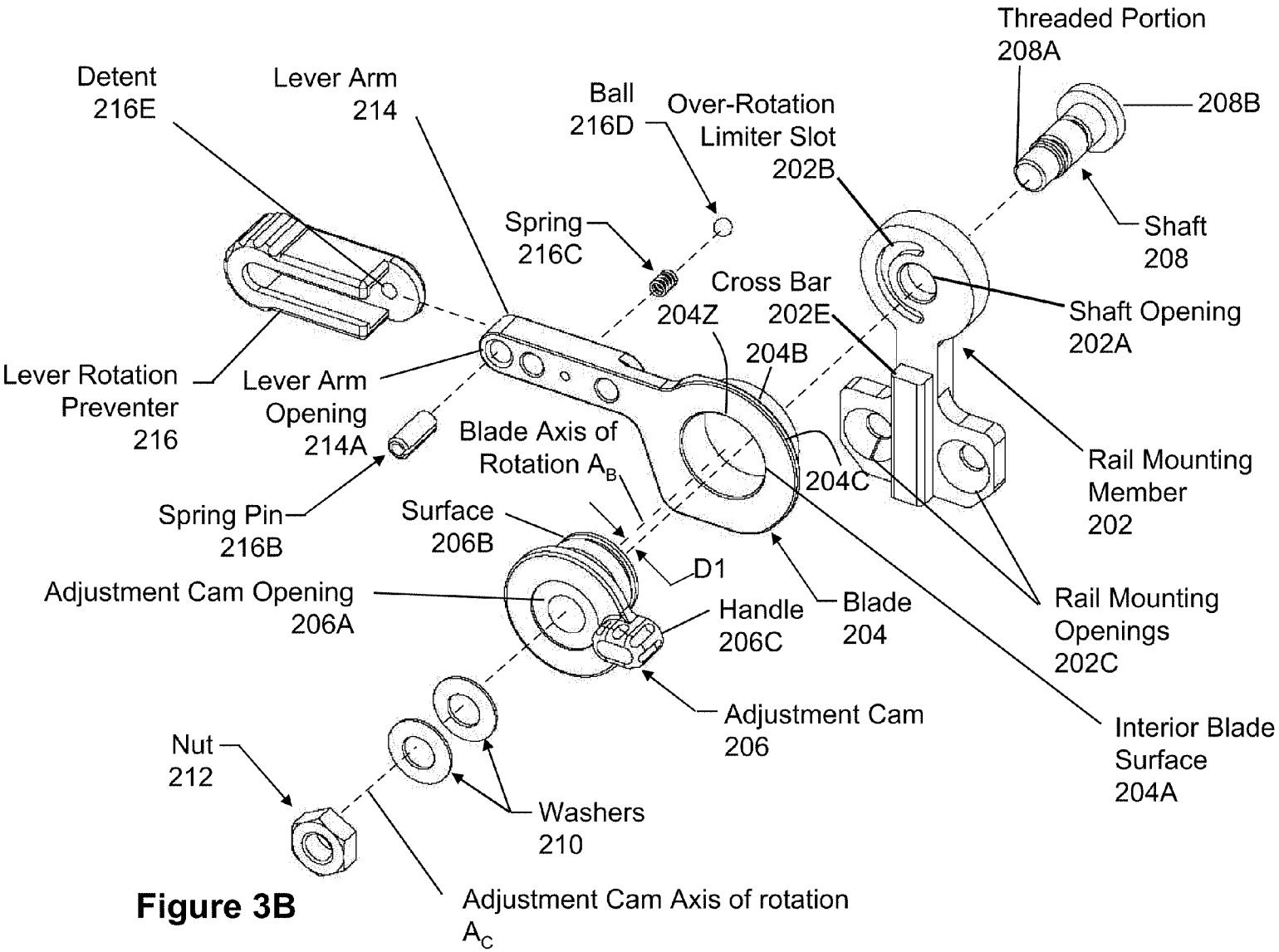
FIG. 3B is an exploded view of the rail attachment mechanism of FIG. 1.
Figure 4:
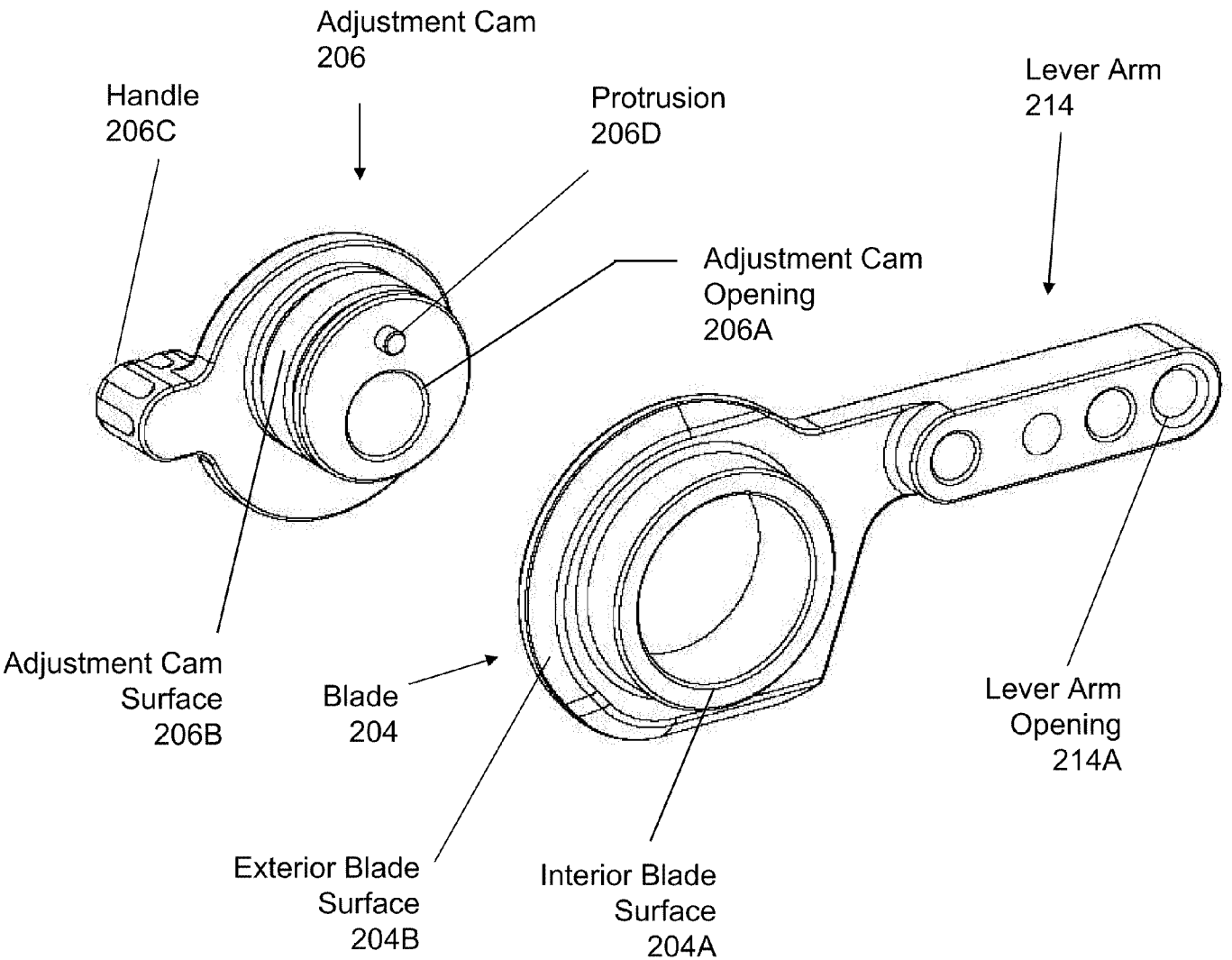
FIG. 4 is a partial exploded view of an adjustment cam and a blade and lever arm of the rail attachment mechanism of FIG. 3A.
Figures 5A, 5B:
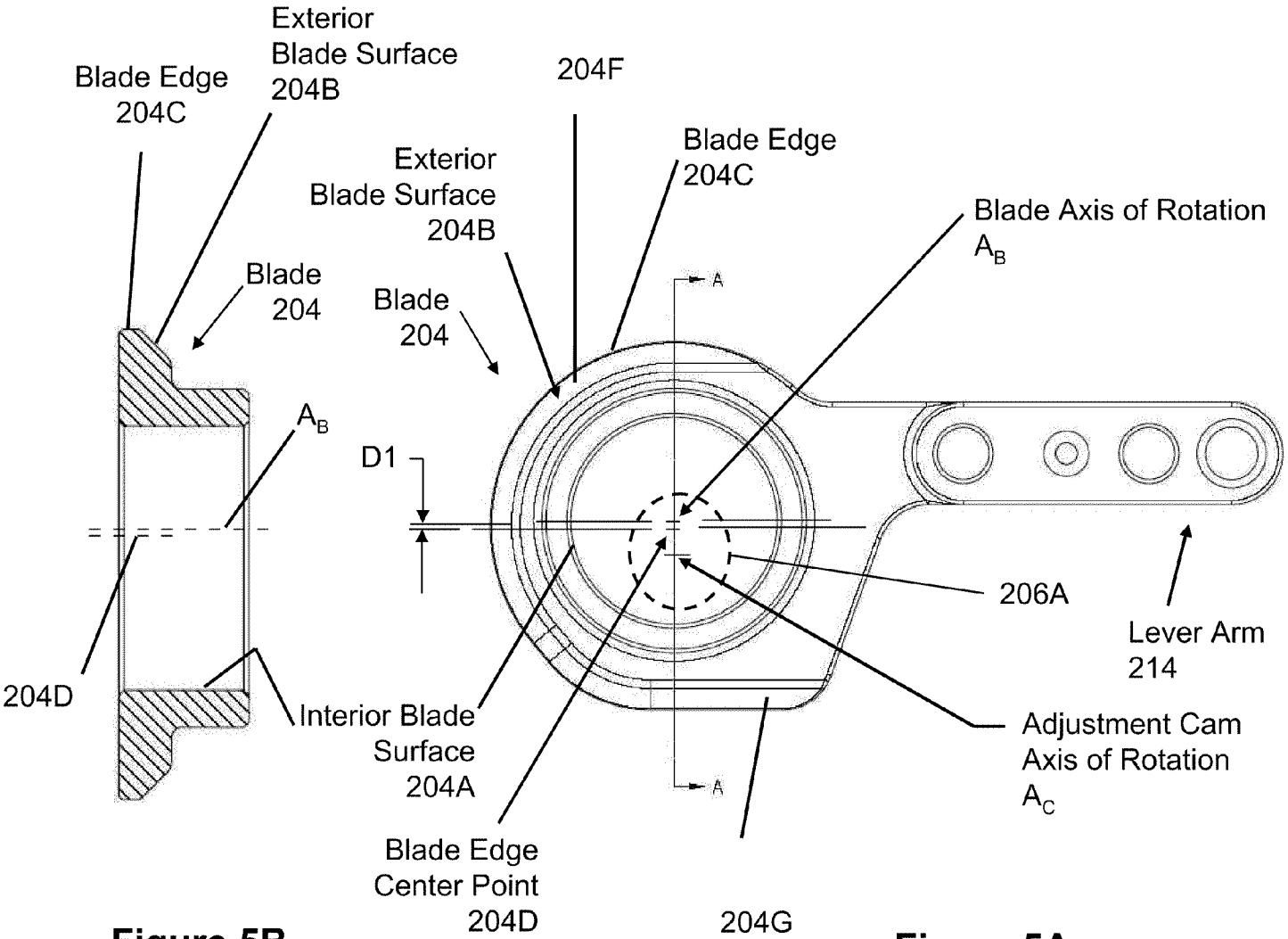
FIG. 5A is a top view of the blade and lever arm of the rail attachment mechanism of FIG. 3A.
FIG. 5B is a section view of the blade of FIG. 5A taken through line A-A.

FIG. 3A is an isometric view and FIG. 3B is an exploded view of the rail attachment mechanism 200 of FIG. 1; FIG. 4 is a partial exploded view of an adjustment cam and a blade and lever arm of the rail attachment mechanism 200 of FIG. 3A; and FIG. 5A is a top view and FIG. 5B is a section view of the blade and lever arm of the rail attachment mechanism 200 of FIG. 3A. The rail attachment mechanism 200 may comprise a rail mounting member 202, a blade 204 having a lever arm 214, and an adjustment cam 206. The blade 204 may be configured to selectively engage the mounting rail 102 (for example, by rotating the lever arm 214 and/or the adjustment cam 206) which, along with the integral clamp member 108 of the housing 106 and the rail mounting member 202, may generally secure (e.g., fix) the position of the auxiliary device 100 relative to the weapon 104.

The rail mounting member 202 may be configured to engage the mounting rail 102 to generally secure and/or fix the position of the auxiliary device 100 along the longitudinal axis LA of the weapon 104. For example, the rail mounting member 202 may comprise at least one cross bar 202E configured to fit in a cross slot 107A-N, thereby preventing movement of the auxiliary device 100 along the longitudinal axis LA of the weapon 104. The rail mounting member 202 may be configured to be removably secured to the housing 106 of the auxiliary device 100, for example, using one or more fasteners (such as, but not limited to, screws, bolts, pins, rivets, or the like, not shown). The rail mounting member 202 may alternatively be an integral component (i.e., a unitary part of) the housing 106.

According to at least one embodiment, at least a portion of the blade 204 may be configured to selectively move into and out of engagement with the mounting rail 102 by rotation of the adjustment cam 206 and/or the lever 214. The combination of the blade 204 with a lever 214 and the adjustment cam 206 may allow the rail attachment mechanism 200 to secure the auxiliary device 100 to a wider range of weapons 104 and/or mounting rails 102, and may also accommodate a larger range of production tolerances and/or wear associated with the mounting rails 102. The contour of the exterior blade surface 204B, the interior blade surface 204A, and the adjustment cam surface 206B may be modified to achieve a desired clamping force.

A shaft 208 may be configured to allow the blade 204 and lever arm 214 as well as the adjustment cam 206 to rotate relative to the rail mounting member 202. The shaft 208 may be inserted through a shaft opening 202A in the rail mounting member 202, an opening 204Z in the blade 204, an adjustment cam opening 206A in the adjustment cam 206, and one or more washers 210. A proximal end of the shaft 208 may include a base or shoulder portion 208B having a cross-section greater than the shaft opening 202A in the rail mounting member 202 and a distal end may include a threaded portion 208A that may cooperate with a nut 212. The shaft base or shoulder portion 208B may be configured to cooperate with the rail mounting member 202 to resist rotation relative to one another. Alternatively, the rail mounting member 202 and the shaft 208 may be integrally formed (i.e., a signal component) in which the shaft 208 extends generally outwardly from the rail mounting member 202 (and as such, would not necessarily extend through the rail mounting member 202).

The adjustment cam 206 may be configured to rotate within the blade opening 204Z of blade 204 about an adjustment cam axis of rotation $A_C$ and the shaft 208. Rotation of the adjustment cam 206 may selectively alter the distance between the integral clamp member 108 and a portion of the blade 204 closest to the integral clamp member 108 and may urge a portion of the blade 204 into and/or out of engagement/contact with mounting rail 102 of the weapon 104. For example, the adjustment cam 206 may have a surface 206B (for example, but not limited to, a generally cylindrical surface) configured to be received within the blade opening 204Z and to be generally in contact with an interior blade surface 204A of the blade 204 (for example, but not limited to, a generally cylindrical surface). The center point of the surface 206B may be offset relative to the adjustment cam axis of rotation $A_C$ such that rotation of the adjustment cam 206 about the adjustment cam axis of rotation $A_C$ will cause the center point of the blade opening 204Z to move relative to the adjustment cam axis of rotation $A_C$ (for example, in a cam-like manner).

The adjustment cam 206 may have a handle 206C extending generally outwardly from the adjustment cam 206. The handle 206C may be configured to allow a user's finger to rotate the adjustment cam 206. The adjustment cam 206 may also have a protrusion 206D (see FIG. 4) configured to travel within an over-rotation limiter slot 202B (see FIG. 3B) as the adjustment cam 206 is rotated about the adjustment cam axis of rotation $A_c$. The over-rotation limiter slot 202B may be configured to limit the movement of the protrusion 206D, thereby limiting the maximum rotation of the adjustment cam 206. According to at least one embodiment, the over-rotation limiter slot 202B may be configured to limit the rotation of the adjustment cam 206 to a 180 degree arc; however, the exact amount of rotation of the adjustment cam 206 may be selected depending upon the intended application and may be greater than or less than 180 degrees.

The blade 204 may be rotatable relative to the surface 206B of the adjustment cam 206 about a blade axis of rotation $A_B$, for example, by way of the lever arm 214 extending generally outwardly and away from the blade 204. Rotation of the blade 204 may selectively alter the distance between the integral clamp member 108 and a portion of the blade 204 closest to the integral clamp member 108 and may urge a portion of the blade 204 into and/or out of engagement/contact with mounting rail 102 of the weapon 104.

Figure 8:
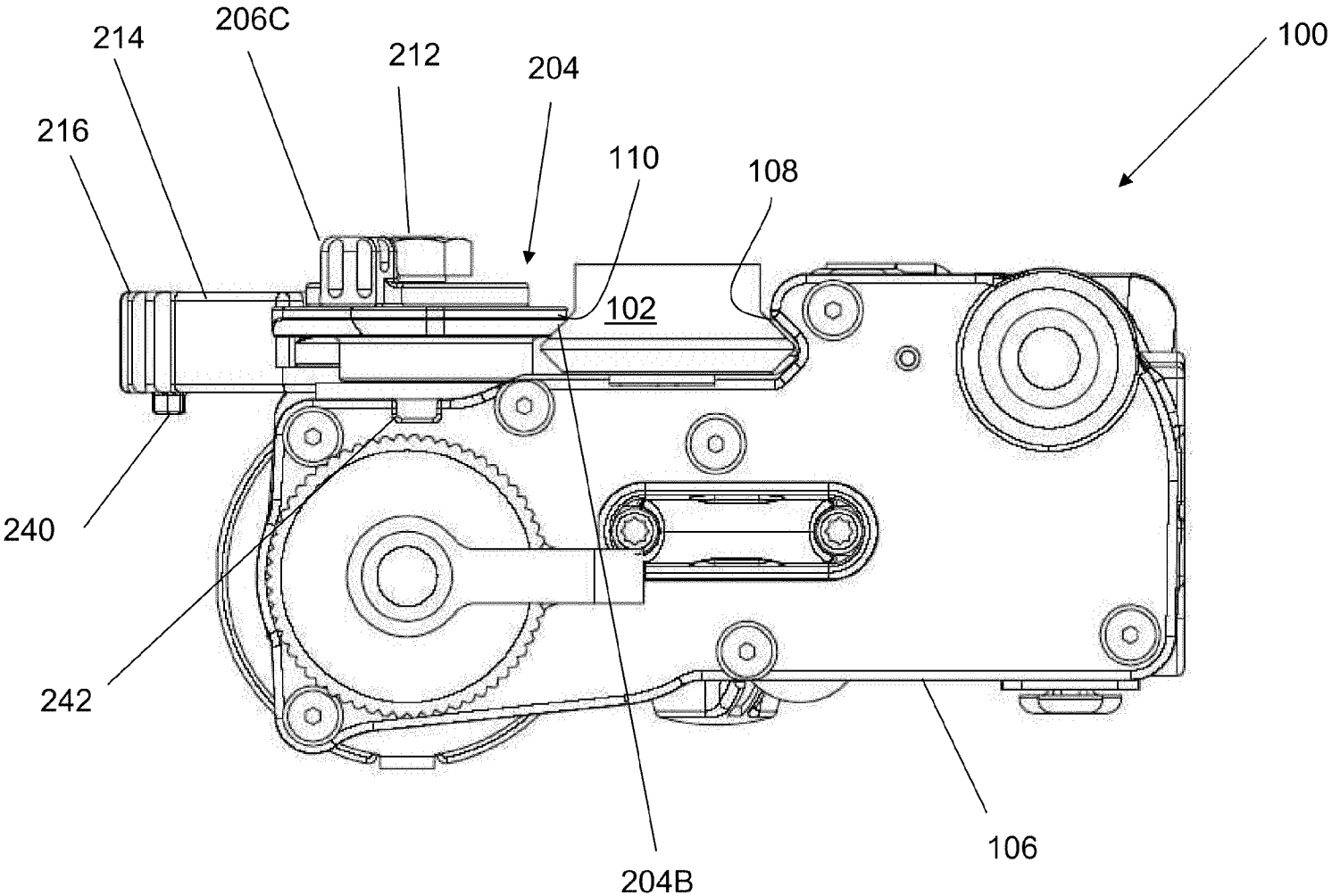
FIG. 8 is an end view of the auxiliary device of FIG. 1 being secured to a mounting rail.

The blade 204 may have an exterior surface 204B and a blade edge 204C. Rotation of the adjustment cam 206 and/or lever 214 may urge the exterior surface 204B into and/or out of engagement with mounting rail 102 of the weapon to selectively generate a clamping force for coupling the auxiliary device 100 to the weapon 104. For example, as generally illustrated in FIGS. 5A, 5B and 8, the exterior blade surface 204B may comprise a tapered surface which may be disposed at an angle to the blade axis of rotation $A_B$ and be generally parallel to a surface 110 of a cooperating mounting rail 102. As the taper of the exterior blade surface 204B engages the mounting rail 102, the taper may urge the blade 204 (and therefore the auxiliary device 100) towards the weapon 104.

The exterior blade surface 204B may comprise a first section 204F and at least a second section 204G. The first section 204F may be spaced generally equidistance from a blade edge center point 204D (for example, the first section 204F may have a generally arcuate configuration having a generally constant radius extending from blade edge center point 204D) and the second section 204G may have a generally straight or linear configuration (for example, the second section 204G may extend generally tangentially from a portion of the first section 204F). The blade edge center point 204D may be offset relative to the blade axis of rotation $A_B$, for example, by a distance D1 as generally illustrated in FIG. 5A. As a result, rotation of the blade 204 about the blade axis of rotation $A_B$ may result in a lateral movement of the blade edge 204C relative to the integral clamp member 108. The contour of the blade edge 204C and blade surface 204B may be changed to provide a different gripping force without departing from the present disclosure. For example, the first section 204F may have an arcuate configuration in which the radius from the blade edge center point 204D may vary along the length of the first section 204F. Additionally, or alternatively, the taper of the blade edge 204C may be altered and/or the second section 204G may be eliminated.

Figure 7A:
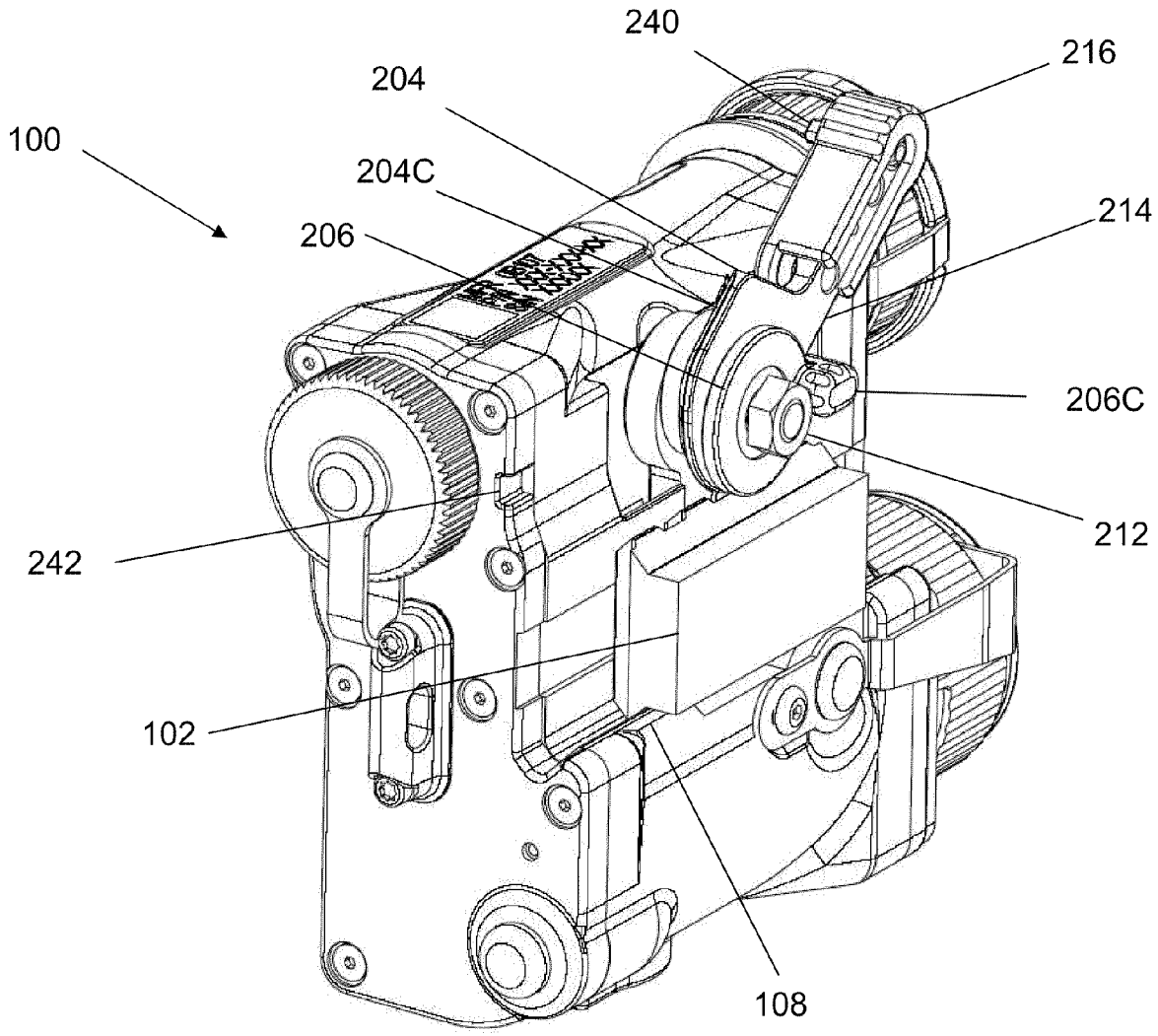
FIG. 7A is a first isometric view of the auxiliary device of FIG. 1 with the rail attachment mechanism in the first position.

Turning now to FIGS. 3B, 7A and 8, a lever rotation preventer 216 may be configured to selectively allow and/or prevent the lever arm 214 from rotating relative to the housing 106. For example, the lever rotation preventer 216 may be configured to translate relative to the lever arm 214, for example, along a longitudinal axis of the lever arm 214. According to at least one embodiment, the lever rotation preventer 216 may be configured to be disposed in a first position along the lever 214 wherein a protrusion 240 extending outwardly from the lever rotation preventer 216 may engage a notch or cavity 242 on the housing 106, thereby generally preventing rotation of the lever arm 214, and thus movement of the blade 204 due to rotation of the lever arm 214, with respect to the housing 106. The lever rotation preventer 216 may also be configured to be disposed in a second position along the lever 214 wherein the lever rotation preventer 216 is generally disengaged from the housing 106 such that the lever arm 214, and thus the blade 204, may generally rotate relative to the housing 106.

Consistent with at least one embodiment, the lever rotation preventer 216 may include a spring pin 216B configured to extend through a lever arm opening 214A and then into a slotted opening (not shown) in the lever rotation preventer 216. A spring 216C and a ball 216D may form a detent mechanism with one or more detents 216E in the lever rotation preventer 216 to selectively fix the position of the lever rotation preventer 216 along the length of the lever arm 214 (for example, in the first and second positions). The engagement of the spring 216C and ball 216D with the detents 216E may provide visual, auditory, and/or tactile feedback to the user to determine when the lever rotation preventer 216 is fully engaged in first and/or second positions.

Figure 6A:
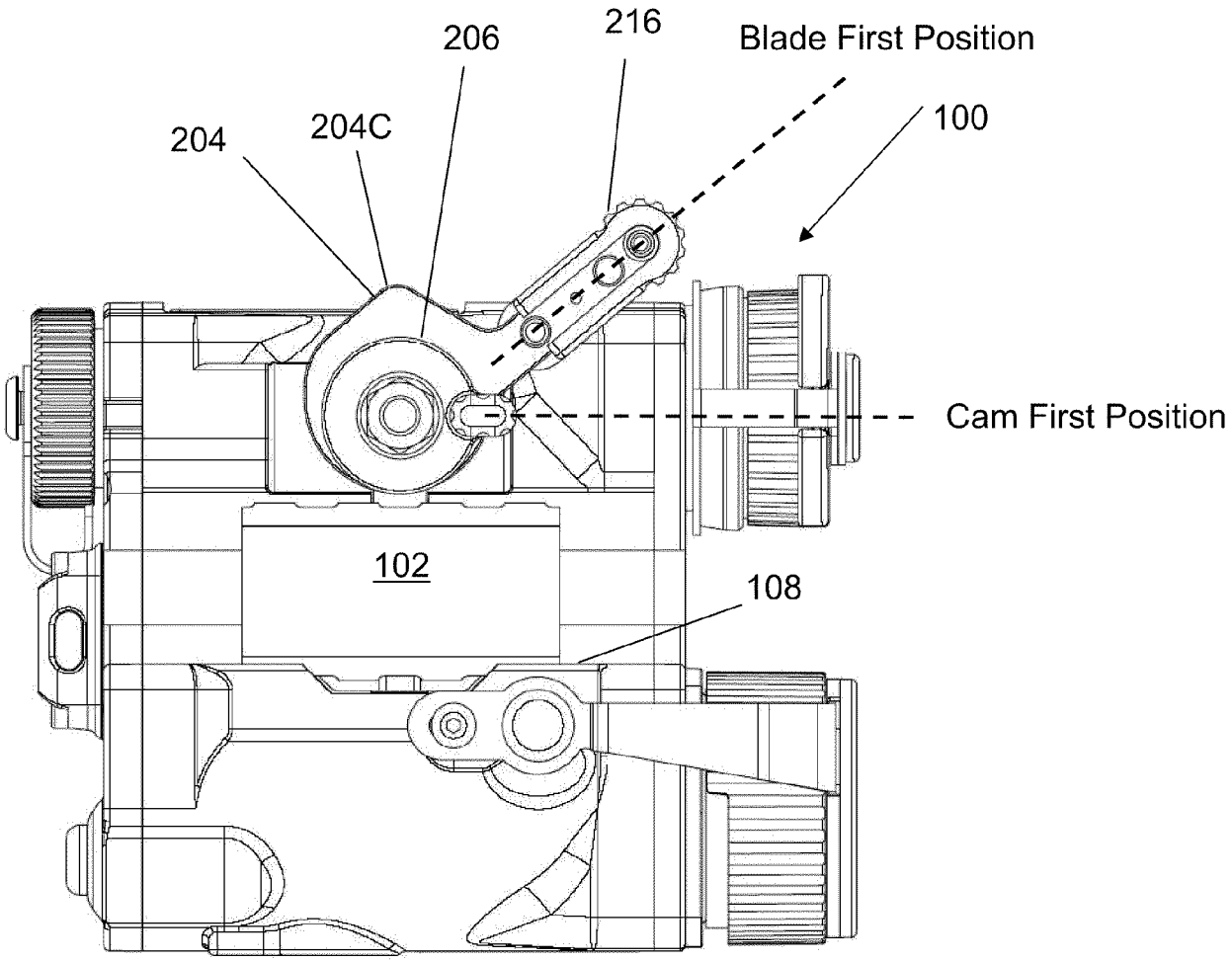
FIG. 6A is a first bottom view of the auxiliary device of FIG. 1 with the rail attachment mechanism in a first position.
Figure 6B:
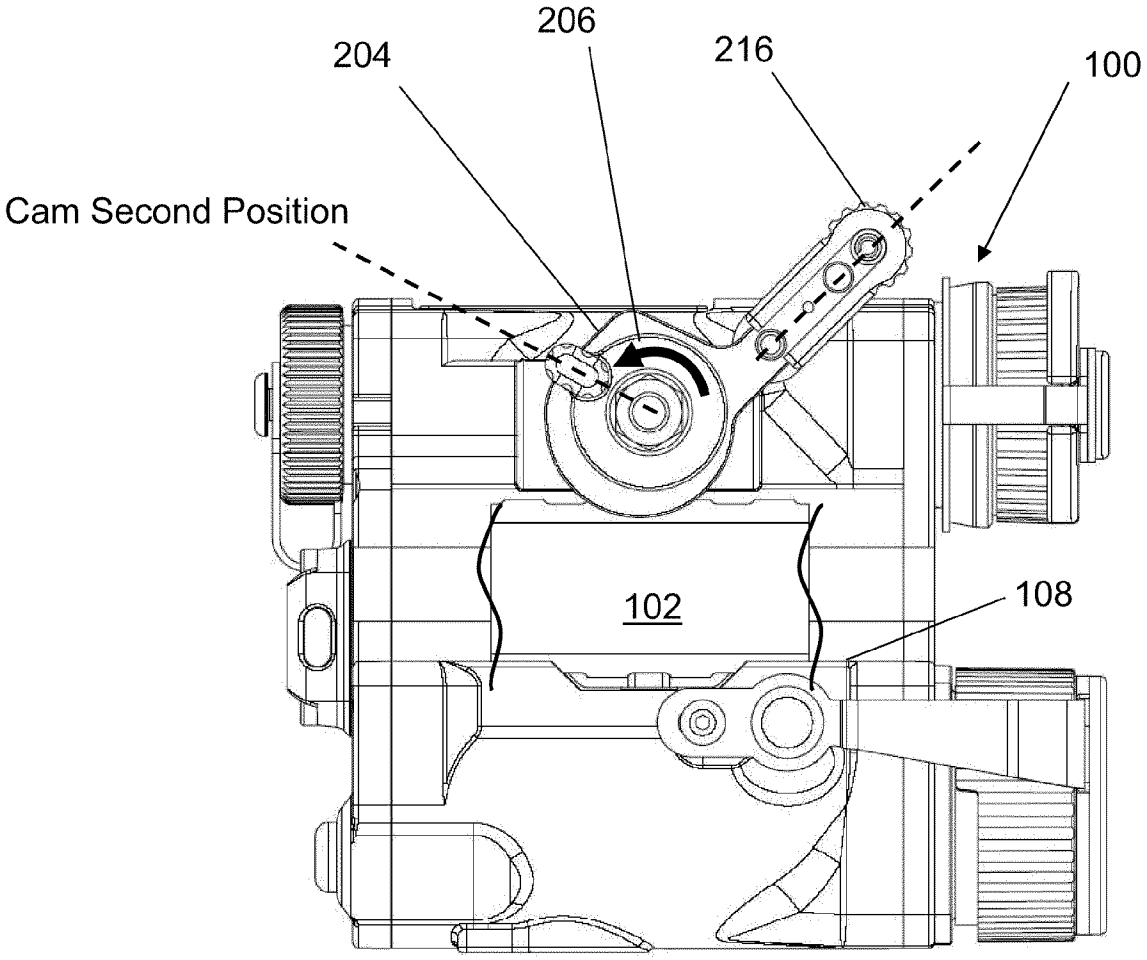
FIG. 6B is a second bottom view of the auxiliary device of FIG. 1 with the rail attachment mechanism in a second position.
Figure 6C:
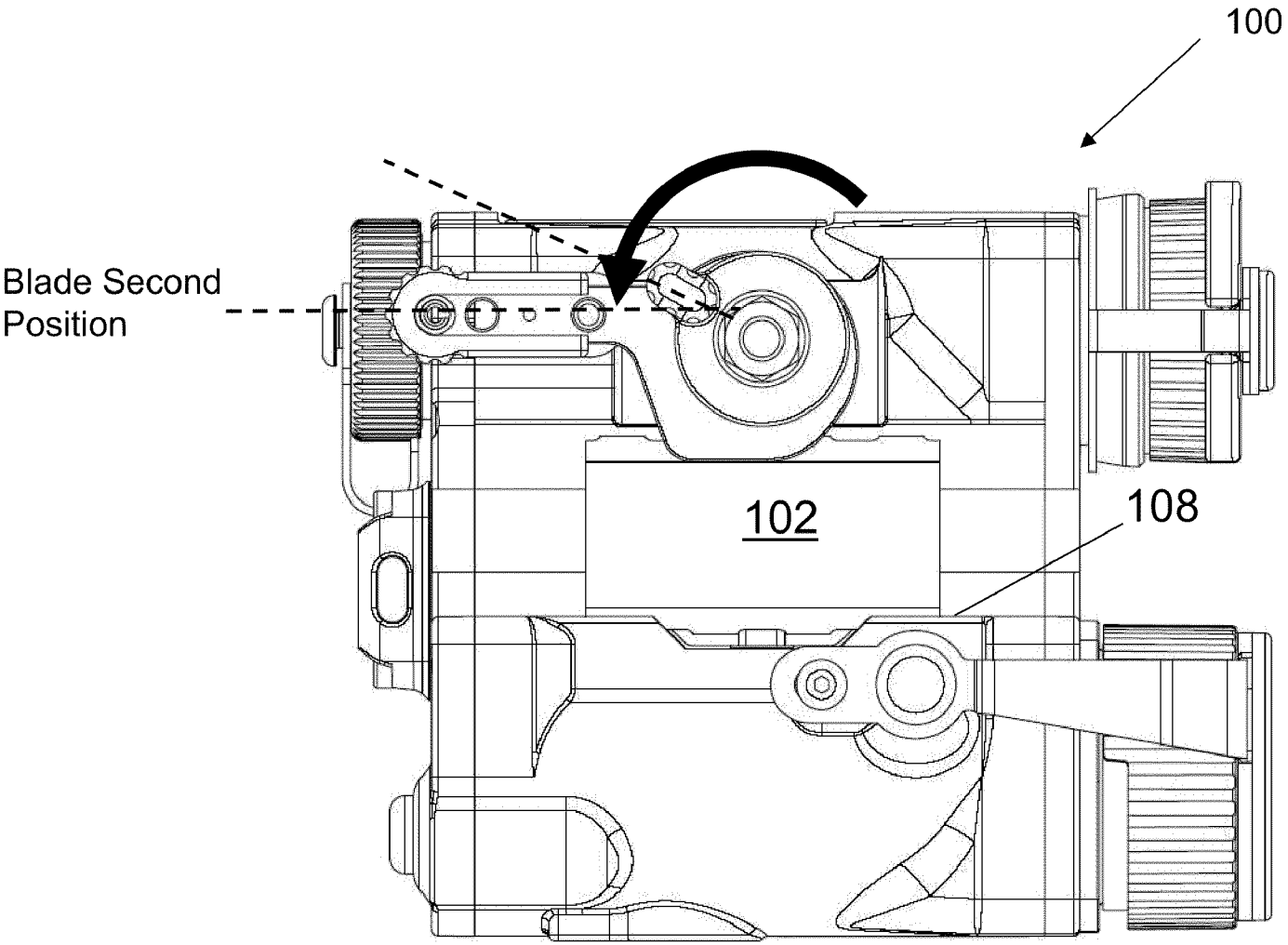
FIG. 6C is a third bottom view of the auxiliary device of FIG. 1 with the rail attachment mechanism in a third position.
Figure 7B:
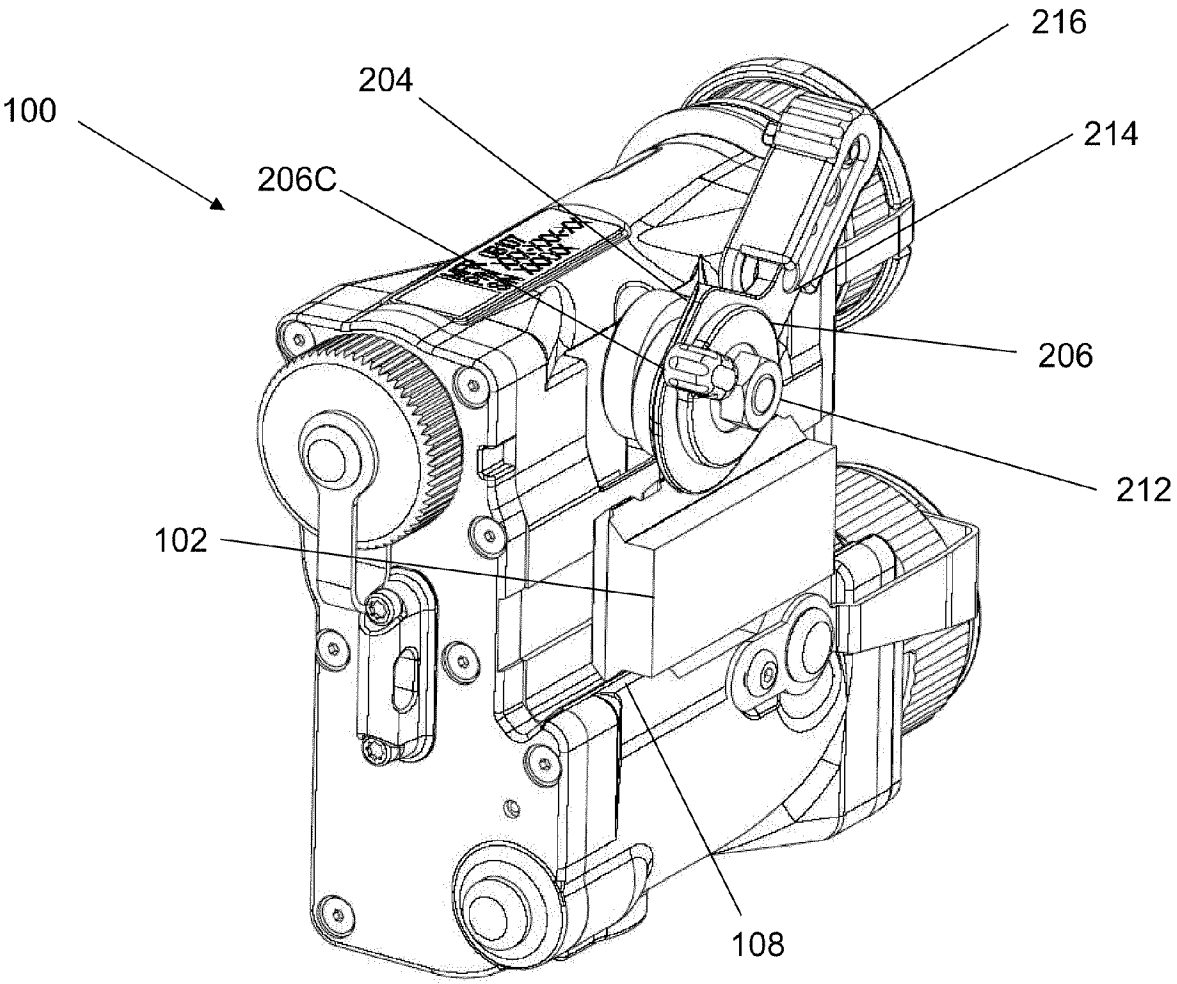
FIG. 7B is a second isometric view of the auxiliary device of FIG. 1 with the rail attachment mechanism in the second position.
Figure 7C:
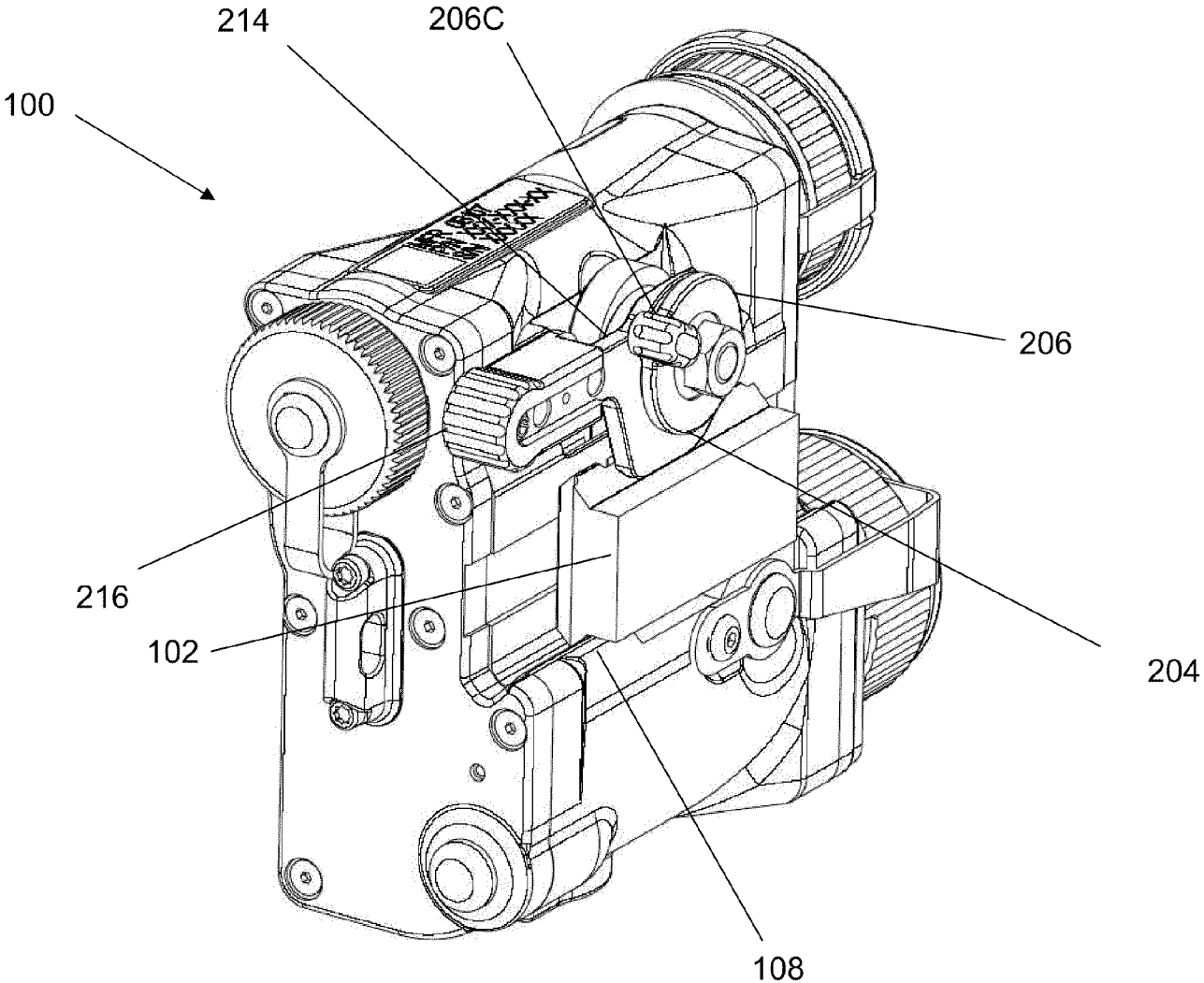
FIG. 7C is a third isometric view of the auxiliary device of FIG. 1 with the rail attachment mechanism in the third position.

FIG. 6A is a first bottom view and FIG. 7A is a first isometric view of the auxiliary device 100 generally illustrating the rail attachment mechanism 200 in a first position (e.g., unsecured or unlocked); FIG. 6B is a second bottom view, FIG. 7B is a second isometric view, and FIG. 8 is an end view of the auxiliary device 100 generally illustrating the rail attachment mechanism 200 in a second position (e.g., an intermediate position); and FIG. 6C is a third bottom view and FIG. 7C is a third isometric view of the auxiliary device 100 generally illustrating the rail attachment mechanism 200 in a third position (e.g., a secured or locked position). By way of example, when a user wishes to secure the auxiliary device 100 to a mounting rail 102, the user may rotate the blade 204 and the adjustment cam 206 (clockwise in this example) to the positions generally illustrated in FIGS. 6A and 7A. In this position, the blade edge 204C may generally be disposed a sufficient distance away from integral clamp member 108 to allow the rail attachment mechanism 200 to be disposed over the mounting rail 102. For example, the blade edge 204C may be disposed furthest from the mounting rail 102 to provide the most room to insert the mounting rail 102 between the integral clamp member 108 and the blade edge 204C. After the mounting rail 102 is inserted between the integral clamp member 108 and the blade edge 204C, the user can rotate the adjustment cam 206 (counter-clockwise in this example) until the blade surface 204B comes into contact with the mounting rail 102 as generally illustrated in FIGS. 6B, 7B, and 8. The user can then rotate the blade 204 (counter-clockwise in this example) using the lever arm 214 until the blade 204 is in the secured or locked position as generally illustrated in FIGS. 6C and 7C. According to at least one embodiment, the blade surface 204B may engage the rail 102. In this position, the auxiliary device 100 is secured or locked to the rail 102. The actual rotational positions of the adjustment cam 206 and the blade 204 may be changed without departing from the present disclosure.

Figure 9B:
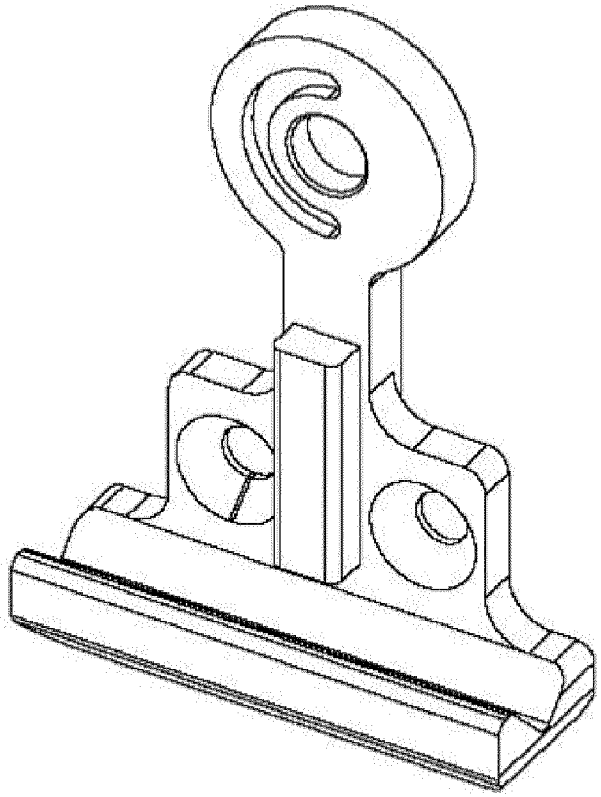
FIG. 9B is an isometric view of a mounting plate having an integral clamp member that may be used in the rail attachment mechanism of FIG. 9A.
Figure 9A:
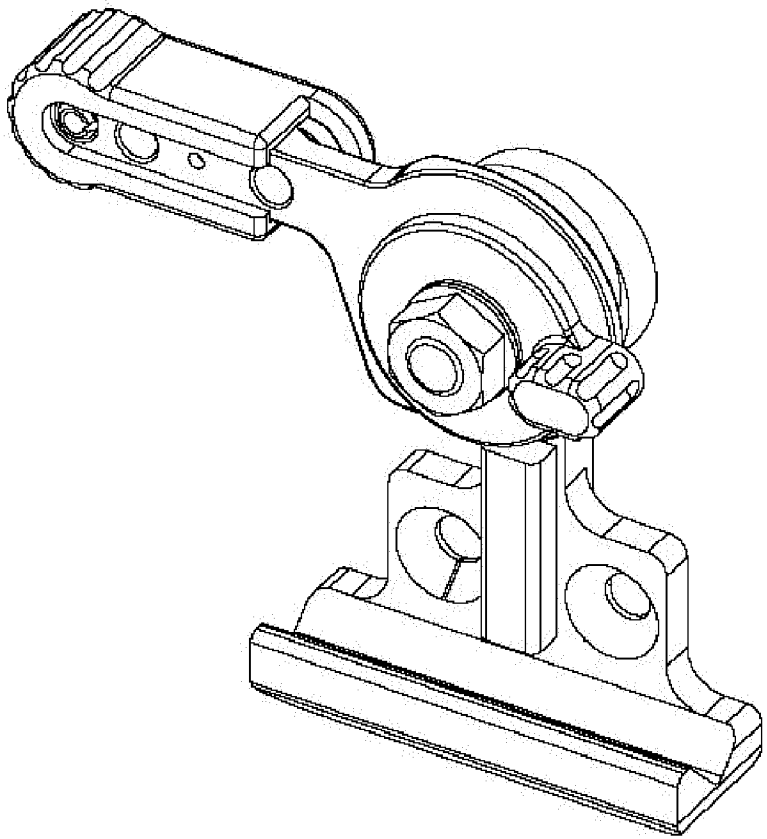
FIG. 9A is an isometric view of a rail attachment mechanism consistent with a second embodiment of the present disclosure.

FIG. 9A is an isometric view of a rail attachment mechanism consistent with another embodiment of the present disclosure and FIG. 9B is an isometric view of another embodiment of a mounting plate having an integral clamp member that may be used in the rail attachment mechanism of FIG. 9A. This embodiment may work the same as the embodiment described above. In an alternative embodiment, the mounting plate and clamp member may be an integral part of the housing.

Figure 10:
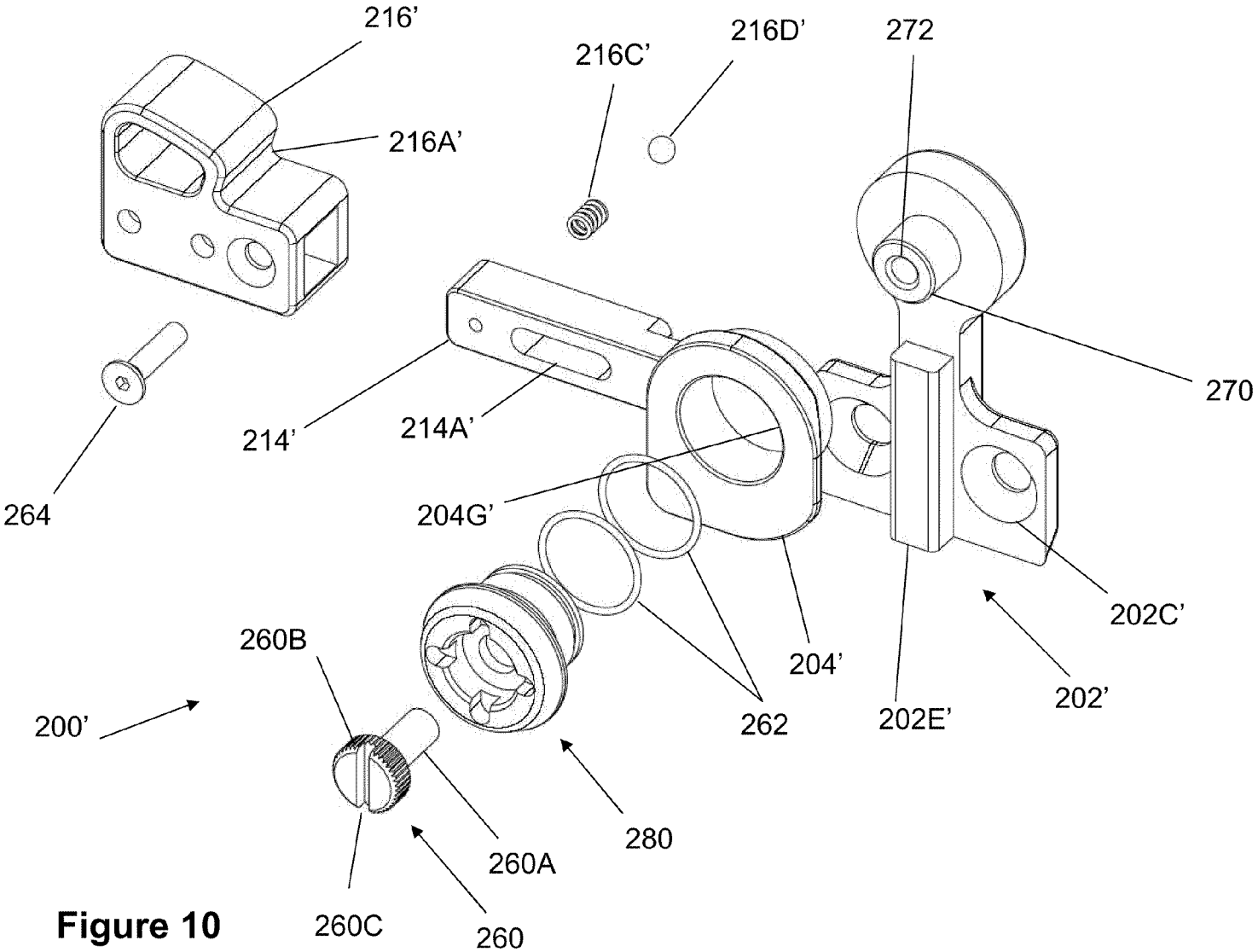
FIG. 10 is an exploded view of a rail attachment mechanism consistent with a third embodiment of the present disclosure.
Figure 11:
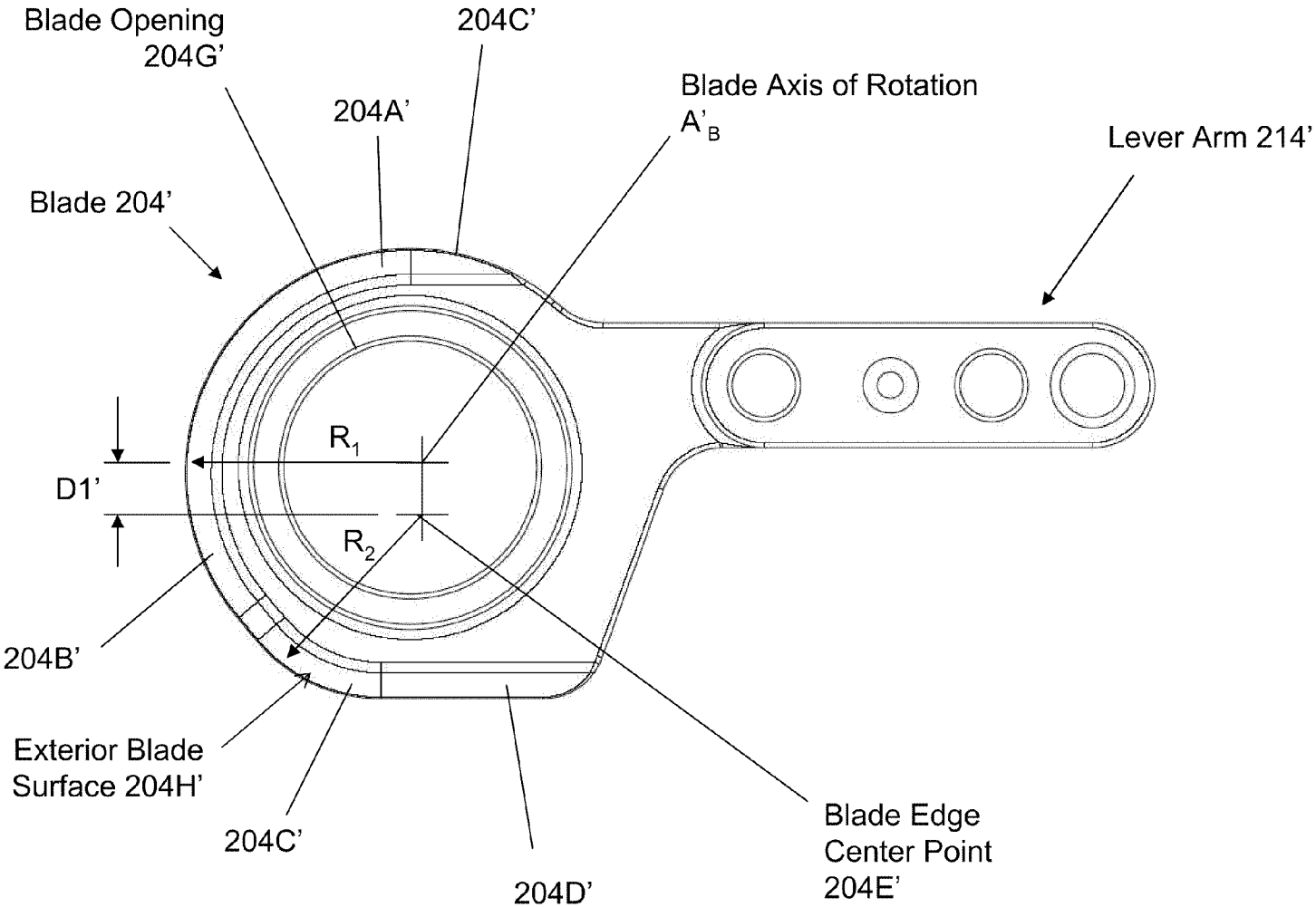
FIG. 11 is a top view of a blade and lever arm of the rail attachment mechanism of FIG. 10.

FIG. 10 is an exploded view of a rail attachment mechanism 200' consistent with yet another embodiment of the present disclosure, FIG. 11 is a top view of a blade 204' and lever arm 214' of the rail attachment mechanism of FIG. 10, and FIGS. 12A, 12B, and 12C are views of an eccentric rotation hub 280. The rail attachment mechanism 200' may have a removable rail mounting member 202', the blade 204' having the lever arm 214', a lever rotation preventer 216', the eccentric rotation hub 280, and a first fastener 260. The lever rotation preventer 216' may be slidable along the lever arm 214' between a "locked" and an "unlocked" position by a detent mechanism, for example a spring 216C' and a ball 216D'. The lever rotation preventer 204' may be retained to the lever arm 214' by a second fastener 264 that slides in a slot 214A'.

The removable rail mounting member 202' may have a cross bar 202E', an upstanding portion 270 with a threaded opening 272 that cooperates with the first fastener 260, and one or more openings 202C' for securing the removable rail mounting member 202' to an auxiliary device. One or more O-rings 262 may be coupled to the eccentric rotation hub 280 to keep contaminants out and to create drag which may help maintain the lever arm 214' in set position during mounting of the auxiliary device 100 to the weapon 104. The lever rotation preventer 216' may have a lip 216A' to facilitate easier grasping of the lever rotation preventer 216'. The fastener 260 may have a threaded portion 260A which may be inserted through an opening in the eccentric rotation hub 280, through an opening in the blade 204', and into opening 272 in the removable rail mounting member 202'. The threaded portion 260A may have a left-handed thread. The fastener 260 may also have a head portion with knurling 260B and a groove 260C for a screwdriver.

Figure 14:
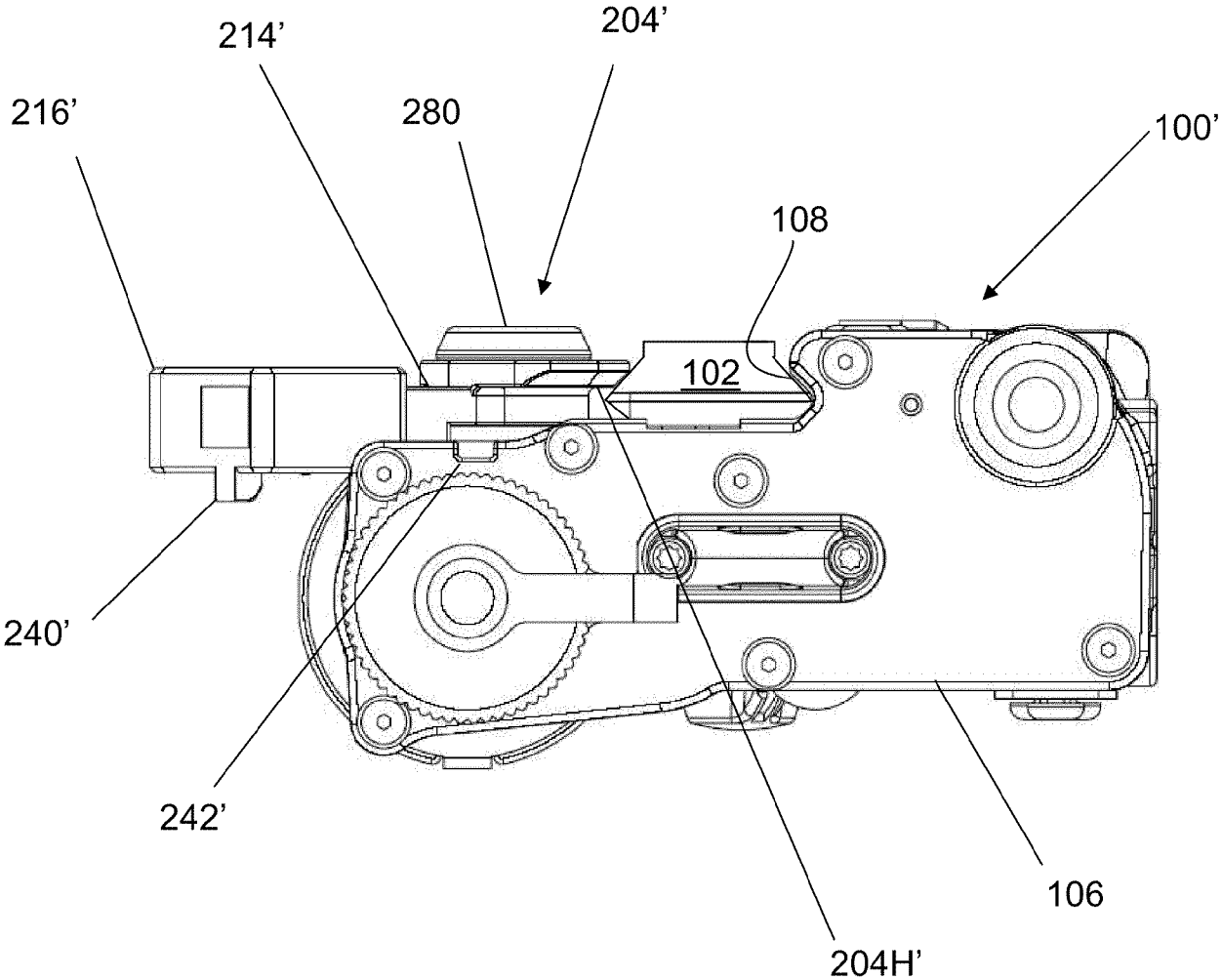
FIG. 14 is an end view of the auxiliary device of FIG. 13A being secured to a mounting rail.

Turning now to FIG. 11, the blade 204' may have a blade axis of rotation A'B separated from a blade edge center point 204E' by a distance D1'. The edge of the blade 204' may have a first curved portion 204A' spaced a distance $R_1$ from blade axis of rotation $A'_B$, a second generally straight portion 204B', a third curved portion 204C' spaced a distance $R_2$ from the blade edge center point 204E', and a forth generally straight portion 204D'. The blade may have more or less blade sections without departing from the present disclosure. The blade 204' may have an opening 204G' extending therethrough that is centered about the blade axis of rotation $A'_B$. The blade 204' may have a tapered surface extending from the blade edge that may contact the rail 102. The exterior blade surfaces may be at an angle to the blade axis of rotation $A_B'$ (e.g., tapered) and be generally parallel to a surface of a cooperating mounting rail, for example, as generally illustrated in FIG. 14. The contour of the blade edges and blade surfaces may be changed to provide a different gripping force without departing from the present disclosure.

Figure 12A:
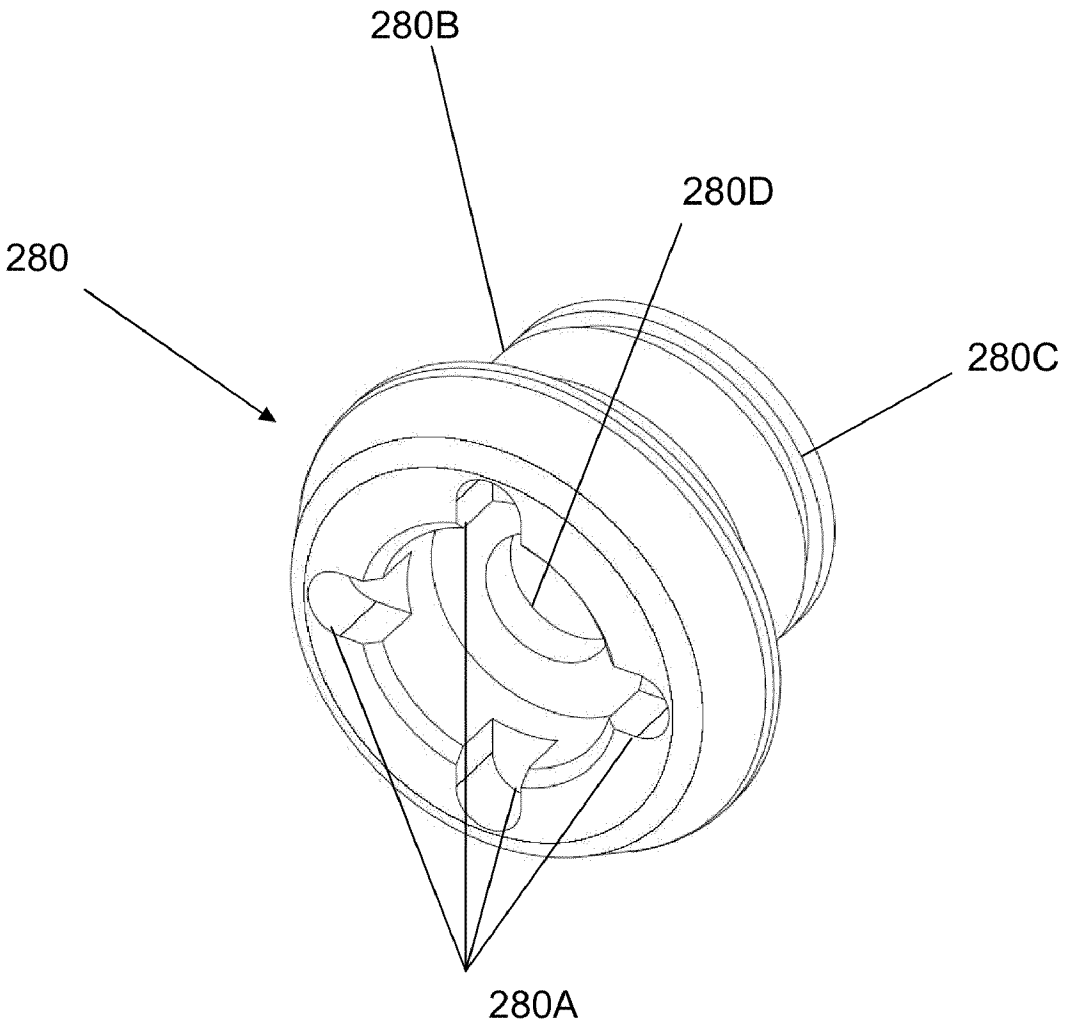
FIG. 12A is an isometric view of an eccentric rotation hub of the rail attachment mechanism of FIG. 10.
Figures 12B, 12C:
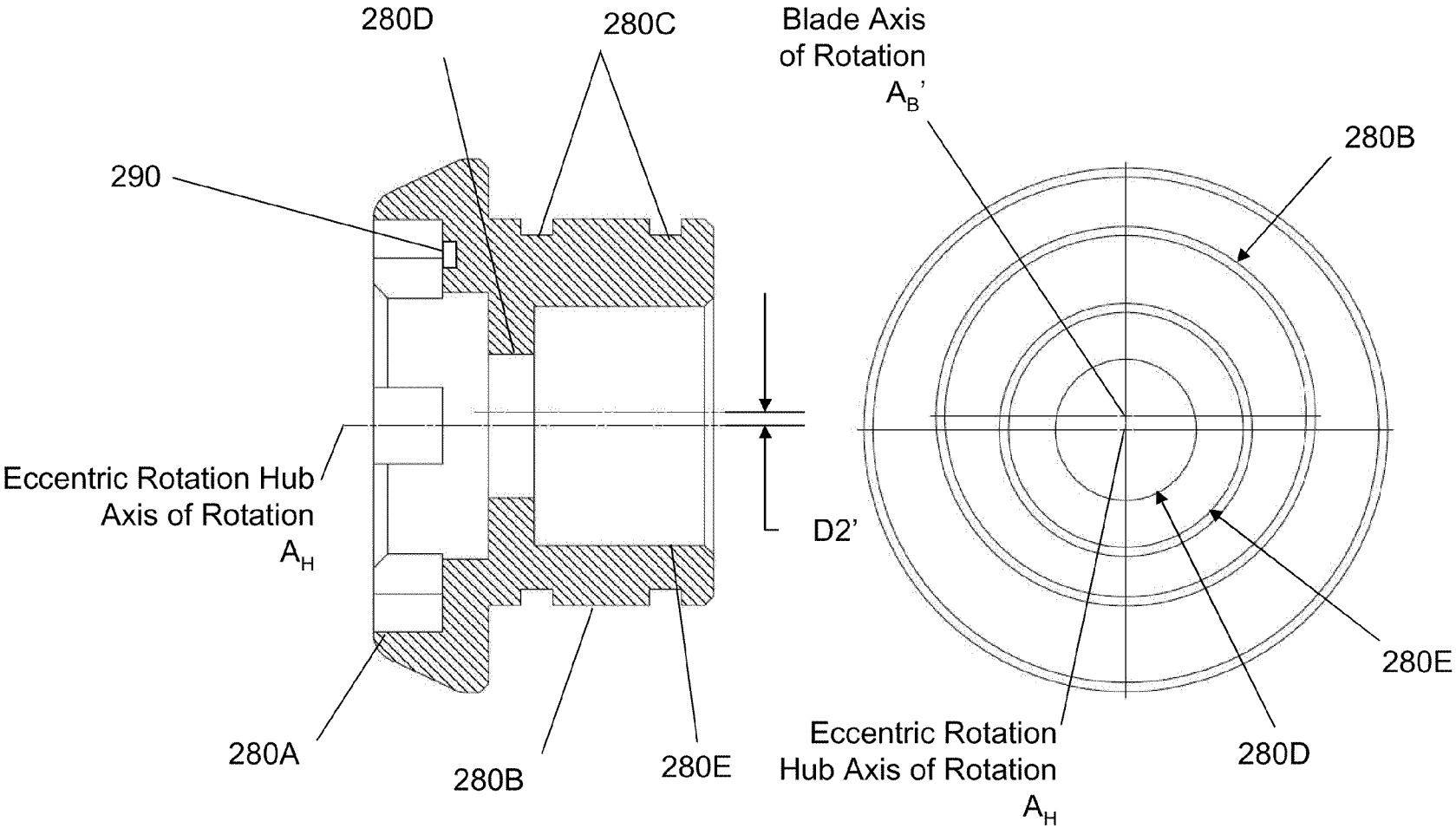
FIG. 12B is a section view of the eccentric rotation hub of FIG. 12A.
FIG. 12C is a rear view of the eccentric rotation hub of FIG. 12A.

FIGS. 12A, 12B, and 12C are views of the eccentric rotation hub 280. The hub 280 may have one or more indentations 280A to allow an assembler to rotate the hub 280 using a spanner tool (not shown) during initial set up. The hub 280 may include a rotational position indicator 290, for example a dimple or other visible mark, to assist in initial setup. The hub 280 may have an opening 280D centered about an eccentric rotation hub axis of rotation $A_H$ that is spaced a distance D2' from the blade axis of rotation $A_B$'. An outer surface 280B of the hub 280 may be spaced equally from the blade axis of rotation $A_B$' and may contact opening 204G' of the blade 204' when assembled. The surface 280B may have one or more grooves 280C for retaining the one or more O-rings 262. The hub 280 may have an internal surface 280E that is centered about the eccentric rotation hub axis of rotation $A_H$. The internal surface 280E may contact upstanding portion 270 of the mounting member 202' when assembled.

Turning back to FIG. 10, the lever arm 214' may assist in rotation of the blade 204' and the lever rotation preventer 216' may be configured to selectively prevent rotation of the lever arm 214'. For example, when the lever rotation preventer 216' is disposed in a first position along the lever arm 214', the lever rotation preventer 216' may engage a protrusion (not shown) on the housing to prevent rotation of the lever arm 214'. When the lever rotation preventer 216' is disposed in a second position along the lever arm 214', the lever rotation preventer 216' may be disengaged from the housing such that the lever may rotate. Alternatively, the lever rotation preventer 216' may have a protrusion 240' as generally illustrated in FIG. 14 that interacts with a notch or cavity 242' in the housings to resist rotation.

Figure 13A:
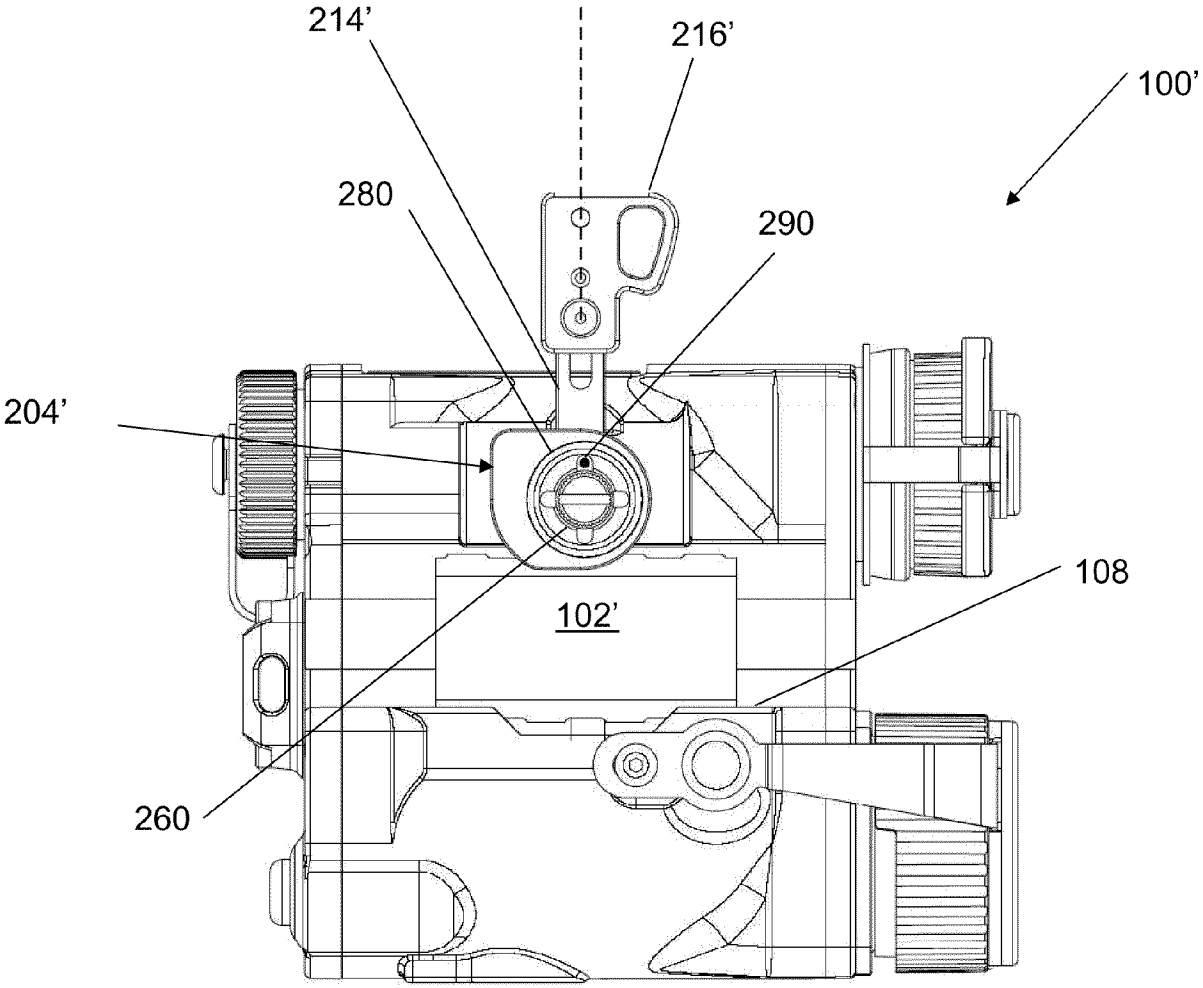
FIG. 13A is a first bottom view of an auxiliary device with the rail attachment mechanism of FIG. 10 in a first position.
Figure 13B:
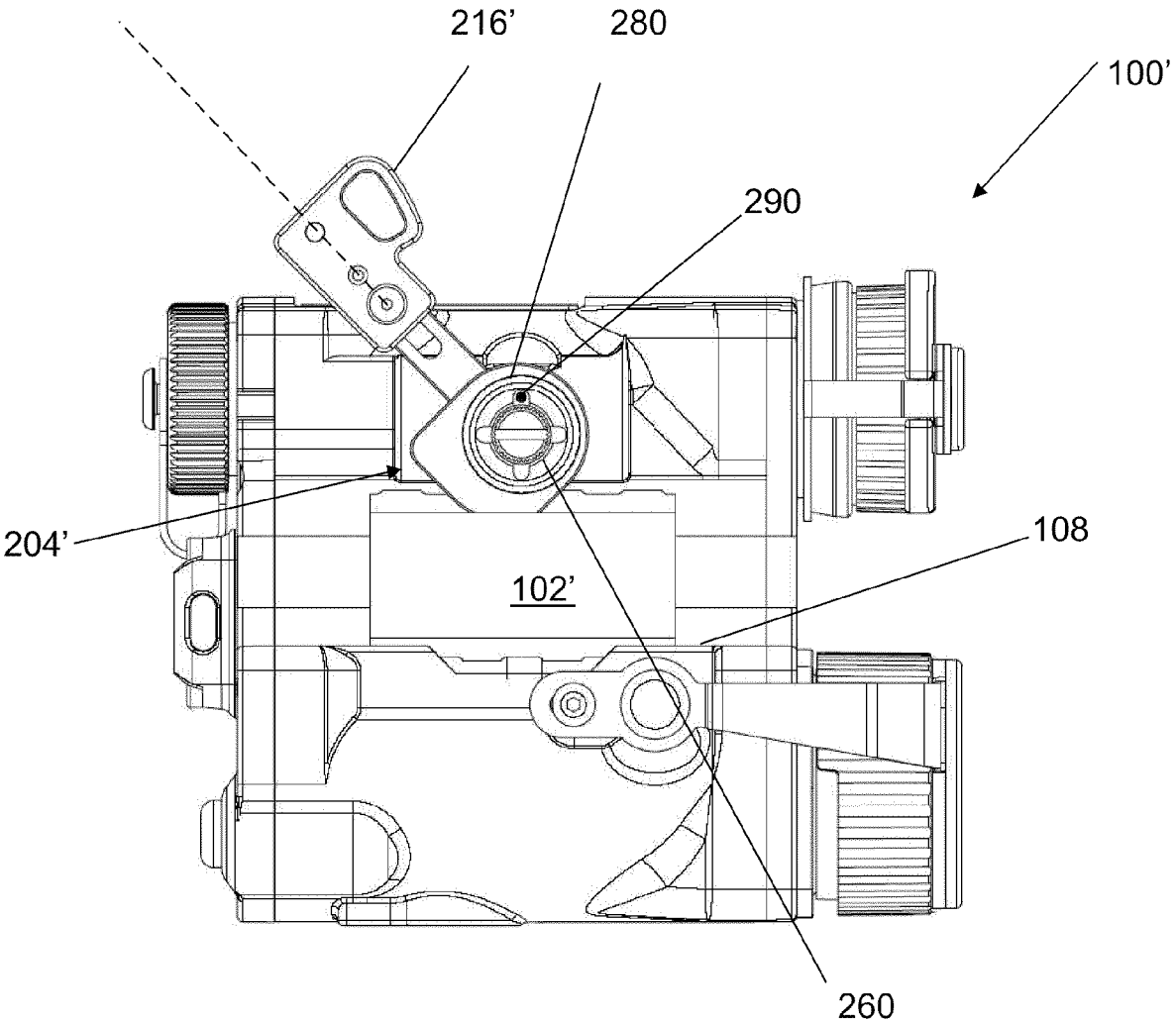
FIG. 13B is a second bottom view of the auxiliary device of FIG. 13A with the rail attachment mechanism of FIG. 10 in a second position.
Figure 13C:
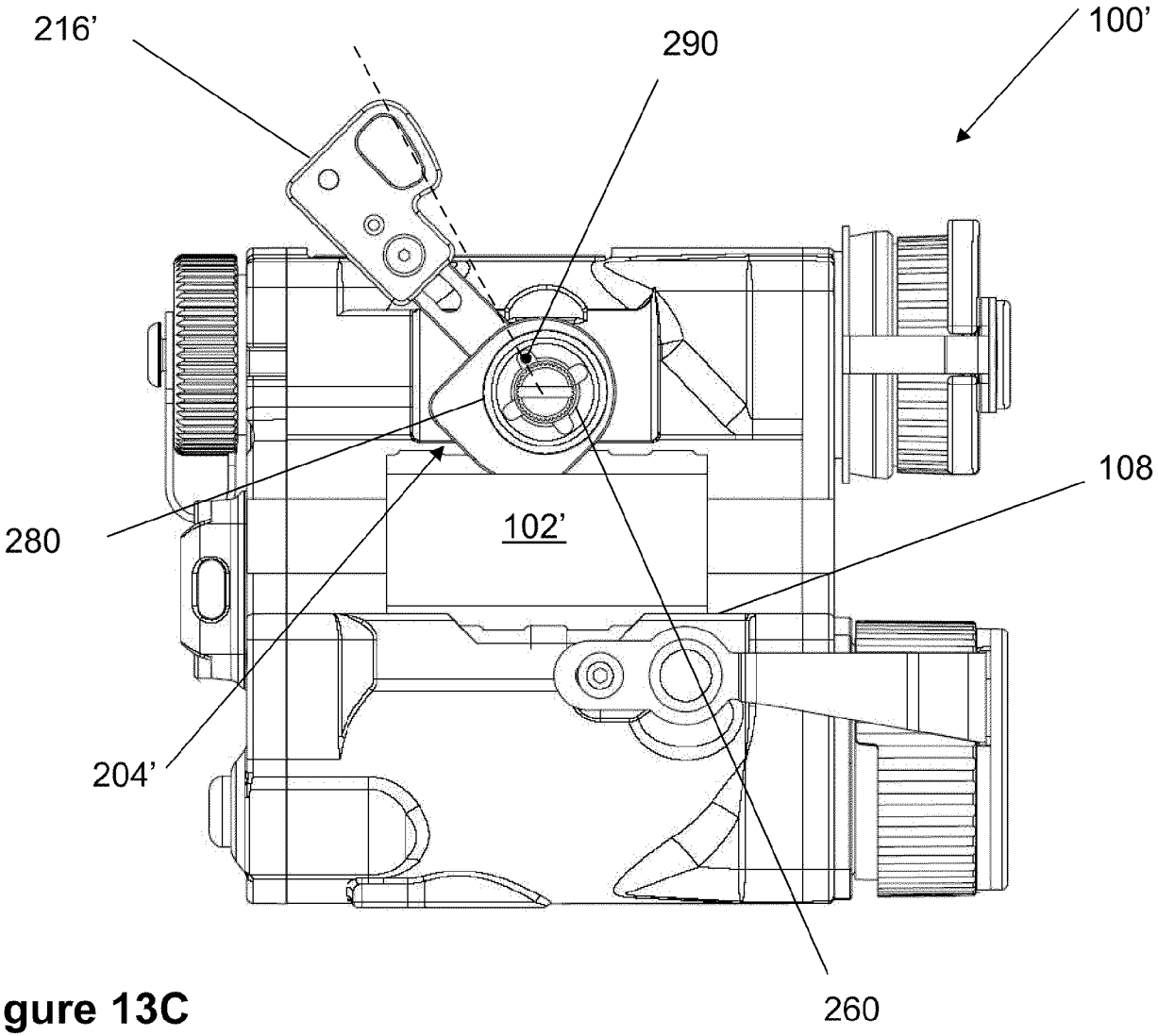
FIG. 13C is a third bottom view of the auxiliary device of FIG. 13A with the rail attachment mechanism of FIG. 10 in a third position.

FIG. 13A is a first bottom view of an auxiliary device 100' with the rail attachment mechanism 200' in a first position (e.g., unsecured or unlocked); FIG. 13B is a second bottom view with the rail attachment mechanism 200' in a second position (e.g., an intermediate position); and FIG. 13C is a third bottom view with the rail attachment mechanism 200' in a third position (e.g., a secured or locked position). During initial set up of the rail attachment mechanism 200', an operator may rotate the blade 204' by hand using the lever arm 214' and rotate the eccentric rotation hub 280 using a spanner tool inserted into the indentations 280A in the eccentric rotation hub 280 to a predetermined first position, for example, the position shown in FIG. 13A, and insert a section of mounting rail 102' between the integral clamp member 108 and the blade edge 240C. In this position, the blade edge may generally be disposed a sufficient distance away from integral clamp member 108 to allow the rail attachment mechanism 200' to be disposed over the mounting rail 102'. For example, the blade edge 204C may be furthest from the mounting rail 102'. The operator may then tighten the fastener 260 to a desired torque value. The desired torque value may depend on component geometry and may be in a range of acceptable torque values. The operator may then rotate the blade 204' to the second position, for example the position shown in FIG. 13B, in which the blade surface, for example 204H', is in contact with the section of rail 102'. The operator may then rotate the eccentric rotation hub 280 to a desired torque value using a spanner tool inserted into the indentations 280A in the eccentric rotation hub 280 (See FIG. 13C) and deposit an adhesive or other bonding material between the knurling 260B on the fastener 260 and the eccentric rotation hub 280 to secure the fastener 260 to the eccentric rotation hub 280 to complete the initial set up. This initial set up step may be used with a section of rail, for example a section of rail having a profile in accordance with MIL-STD-1913, to compensate for tolerances of the assembled parts. The actual rotational positions of the eccentric rotation hub 280 and the blade 204 may be changed without departing from the present disclosure.

When a user desires to mount the auxiliary device 100' to the rail of a weapon, the user may rotate the blade 204' (clockwise in this example) and then insert a mounting rail 102' between the integral clamp member 108 and the blade edge 204C. The O-rings 262 may help keep the blade 204' from undesired rotation during the mounting process. After the mounting rail 102 is inserted between the integral clamp member 108 and the blade edge, the operator can rotate (counter-clockwise in this example) the blade 204' into a "locked position" using the lever arm 214' in which the blade surface 204D' is in contact with the rail 102.

The contour of the blade surface and/or the shape of the blade edge may be modified to create an over-center mechanism in which the force required to rotate the lever arm reaches a maximum value at an intermediate rotational position and then the force required to rotate the lever arm to a secured or locked position decreases.

Attributes of the different embodiments may be combined with each other without departing from the present disclosure.

According to one embodiment, a rail attachment mechanism includes an upstanding member having a first axis of rotation; a clamp member having an axis generally perpendicular to the upstanding member; an adjustment cam having an adjustment cam axis of rotation aligned with the first axis of rotation; and a blade with a lever arm, the blade having a blade axis of rotation generally parallel with the adjustment cam axis of rotation, but spaced therefrom.

According to another embodiment, a method of setting up an auxiliary device to be mounted on a rail includes the steps of positioning a section of rail having a predetermined profile between a blade and a clamp member, the clamp member having an axis generally perpendicular to an axis of rotation of the blade; rotating the blade and an eccentric rotation hub into predetermined first rotational positions; securing the eccentric rotation hub in place with a fastener; rotating the blade to a second rotational position; rotating the eccentric hub to a predetermined minimum torque value; and then securing the fastener to the eccentric rotation hub.

This present disclosure has been described in connection with various embodiments. These embodiments are for example only and are not intended to limit the present disclosure. Various changes and modifications may be made to the embodiments without departing from the scope of the present disclosure as defined by the appended claims. The present disclosure encompasses all devices and equivalents which are within the scope of the claims which follow.

We claim:

1. A rail attachment mechanism, comprising:

a rail mounting member having a cross bar and an upstanding member;

an adjustment cam having a circular outer surface having a first axis of rotation and a circular inner surface having a second axis of rotation; the first axis parallel and spaced from the second axis;

a blade with a lever arm, the blade having a circular inner surface having a third axis of rotation, the inner surface of the blade in contact with and rotatable about the outside surface of the adjustment cam.

2. The rail attachment mechanism of claim 1, wherein the upstanding member has a threaded opening having a longitudinal axis, the longitudinal axis concentric with the first axis of rotation.

3. The rail attachment mechanism of claim 1, wherein the adjustment cam has an opening in to which a fastener is inserted to couple the adjustment cam to the upstanding member.

4. The rail attachment mechanism of claim 3, wherein the fastener has knurling around a head portion and an adhesive is used to secure the fastener to the adjustment cam.

5. The rail attachment mechanism of claim 1, wherein the adjustment cam has at least one indentation to assist in rotating the adjustment cam during initial set up of the rail attachment mechanism, the adjustment cam being rotatable independent of the lever arm.

6. The rail attachment mechanism of claim 1, further comprising a clamp member coupled to a rail mounting member, a longitudinal axis of the cross bar is aligned generally perpendicular to the clamp member.

7. The rail attachment mechanism of claim 1, wherein rotation of the adjustment cam during initial set-up of the rail attachment mechanism moves a blade edge of the blade towards or away from a clamp member spaced from the upstanding member.

8. A rail attachment mechanism, comprising:

a rail mounting member having a cross bar and an upstanding member having a first axis of rotation;

an adjustment cam having a circular outer surface having a second axis of rotation and a circular inner surface having a third axis of rotation; the second axis parallel and spaced from the third axis;

a blade with a lever arm, the blade having a circular inner surface having a fourth axis of rotation, the inner surface of the blade in contact with and rotatable about the outside surface of the adjustment cam, wherein during initial set-up of the rail attachment mechanism, the adjustment cam is rotatable about the adjustment cam axis of rotation independent of the lever arm.

9. The rail attachment mechanism of claim 8, wherein rotation of the adjustment cam during initial set-up of the rail attachment mechanism moves a blade edge of the blade towards or away from a clamp member spaced from the upstanding member.

10. The rail attachment mechanism of claim 8, wherein the adjustment cam inner surface forms an opening through which a fastener is inserted to couple the adjustment cam to the upstanding member.

11. The rail attachment mechanism of claim 10, wherein during initial set up, the fastener is secured to the adjustment cam to prevent rotation of the fastener relative to the adjustment cam.

* * * * *